US008793123B2

(12) United States Patent
Disch

(10) Patent No.: US 8,793,123 B2
(45) Date of Patent: Jul. 29, 2014

(54) APPARATUS AND METHOD FOR CONVERTING AN AUDIO SIGNAL INTO A PARAMETERIZED REPRESENTATION USING BAND PASS FILTERS, APPARATUS AND METHOD FOR MODIFYING A PARAMETERIZED REPRESENTATION USING BAND PASS FILTER, APPARATUS AND METHOD FOR SYNTHESIZING A PARAMETERIZED OF AN AUDIO SIGNAL USING BAND PASS FILTERS

(75) Inventor: Sascha Disch, Fuerth (DE)

(73) Assignee: Fraunhofer-Gesellschaft zur Foerderung der Angewandten Forschung E.V., Munich (DE)

( * ) Notice: Subject to any disclaimer, the term of this patent is extended or adjusted under 35 U.S.C. 154(b) by 954 days.

(21) Appl. No.: 12/922,823

(22) PCT Filed: Mar. 10, 2009

(86) PCT No.: PCT/EP2009/001707

§ 371 (c)(1),
(2), (4) Date: Jan. 4, 2011

(87) PCT Pub. No.: WO2009/115211

PCT Pub. Date: Sep. 24, 2009

(65) Prior Publication Data

US 2011/0106529 A1 May 5, 2011

Related U.S. Application Data

(60) Provisional application No. 61/038,300, filed on Mar. 20, 2008.

(30) Foreign Application Priority Data

Aug. 27, 2008 (EP) ..... 08015123

(51) Int. Cl.
*G10L 19/14* (2006.01)

(52) U.S. Cl.
USPC ..... 704/205; 704/500; 704/200.1; 704/209; 704/220

(58) Field of Classification Search
USPC ..... 704/205, 500–504, 200.1, 209, 207, 704/220; 341/143; 455/265, 180.1, 190.1, 455/189.1, 209; 381/3; 375/240.01, 327, 375/376
See application file for complete search history.

(56) References Cited

U.S. PATENT DOCUMENTS 5,214,708 A * 5/1993 McEachern ..... 704/266

(Continued)

FOREIGN PATENT DOCUMENTS

AU 2009226654 9/2009

(Continued)

OTHER PUBLICATIONS

Potamianos, et al., Speech Analysis and Synthesis Using an AM-FM Modulation Model, Sppech Communication, Jul. 1, 1999, Elsevier Science Publishers, Amsterdam, NL, vol. 28, No. 3, pp. 195-209.

(Continued)

*Primary Examiner* — Vijay B Chawan
(74) *Attorney, Agent, or Firm* — Michael A. Glenn; Perkins Coie LLP

(57) ABSTRACT

Apparatus for converting an audio signal into a parameterized representation, has a signal analyzer for analyzing a portion of the audio signal to obtain an analysis result; a band pass estimator for estimating information of a plurality of band pass filters based on the analysis result, wherein the information on the plurality of band pass filters has information on a filter shape for the portion of the audio signal, wherein the band width of a band pass filter is different over an audio spectrum and depends on the center frequency of the band pass filter; a modulation estimator for estimating an amplitude modulation or a frequency modulation or a phase modulation for each band of the plurality of band pass filters for the portion of the audio signal using the information on the plurality of band pass filters; and an output interface for transmitting, storing or modifying information on the amplitude modulation, information on the frequency modulation or phase modulation or the information on the plurality of band pass filters for the portion of the audio signal.

23 Claims, 17 Drawing Sheets

(56) References Cited

U.S. PATENT DOCUMENTS

| | | | | |
|---|---|---|---|---|
| 5,327,521 | A * | 7/1994 | Savic et al. | 704/272 |
| 5,574,823 | A | 11/1996 | Hassanein et al. | |
| 5,615,302 | A * | 3/1997 | McEachern | 704/209 |
| 6,052,658 | A | 4/2000 | Wang et al. | |
| 6,226,614 | B1 * | 5/2001 | Mizuno et al. | 704/260 |
| 6,336,092 | B1 * | 1/2002 | Gibson et al. | 704/268 |
| 6,629,067 | B1 * | 9/2003 | Saito et al. | 704/207 |
| 6,725,108 | B1 * | 4/2004 | Hall | 700/94 |
| 6,950,799 | B2 * | 9/2005 | Bi et al. | 704/261 |
| 7,027,979 | B2 | 4/2006 | Ramabadran | |
| 7,149,682 | B2 * | 12/2006 | Yoshioka et al. | 704/205 |
| 7,191,134 | B2 * | 3/2007 | Nunally | 704/270 |
| 7,228,273 | B2 * | 6/2007 | Okunoki | 704/224 |
| 7,379,873 | B2 * | 5/2008 | Kemmochi | 704/269 |
| 7,389,231 | B2 * | 6/2008 | Yoshioka et al. | 704/268 |
| 7,464,034 | B2 * | 12/2008 | Kawashima et al. | 704/266 |
| 7,529,363 | B2 * | 5/2009 | Pessoa et al. | 379/386 |
| 7,574,313 | B2 | 8/2009 | Disch et al. | |
| 7,606,709 | B2 * | 10/2009 | Yoshioka et al. | 704/258 |
| 7,664,645 | B2 * | 2/2010 | Hain et al. | 704/269 |
| 7,734,462 | B2 * | 6/2010 | Kabal et al. | 704/201 |
| 7,765,101 | B2 * | 7/2010 | En-Najjary et al. | 704/246 |
| 7,792,672 | B2 * | 9/2010 | Rosec et al. | 704/246 |
| 7,831,420 | B2 * | 11/2010 | Sinder et al. | 704/225 |
| 7,945,446 | B2 * | 5/2011 | Kemmochi et al. | 704/278 |
| 7,974,838 | B1 * | 7/2011 | Lukin et al. | 704/207 |
| 8,010,362 | B2 * | 8/2011 | Tamura et al. | 704/265 |
| 8,099,282 | B2 * | 1/2012 | Masuda | 704/270 |
| 8,131,549 | B2 * | 3/2012 | Teegan et al. | 704/260 |
| 8,315,857 | B2 * | 11/2012 | Klein et al. | 704/211 |
| 8,355,906 | B2 * | 1/2013 | Kabal et al. | 704/219 |
| 2004/0078194 | A1 * | 4/2004 | Liljeryd et al. | 704/200.1 |
| 2008/0037805 | A1 | 2/2008 | Kino et al. | |
| 2010/0191525 | A1 * | 7/2010 | Rabenko et al. | 704/211 |
| 2011/0106529 | A1 * | 5/2011 | Disch | 704/205 |
| 2011/0106547 | A1 * | 5/2011 | Toraichi et al. | 704/501 |

FOREIGN PATENT DOCUMENTS

| | | |
|---|---|---|
| JP | 07261798 | 10/1995 |
| JP | 2004350077 | 12/2004 |
| JP | 2007-535849 | 12/2007 |
| RU | 2005125737 | 1/2006 |
| WO | WO-2007-118583 | 10/2007 |

OTHER PUBLICATIONS

Quatieri et al., AM-FM Separation Using Auditory-Motivated Filters, Sep. 1, 1997, IEEE Transactions on Speech and Audio Processing, IEEE Service Center New York, NY.

* cited by examiner

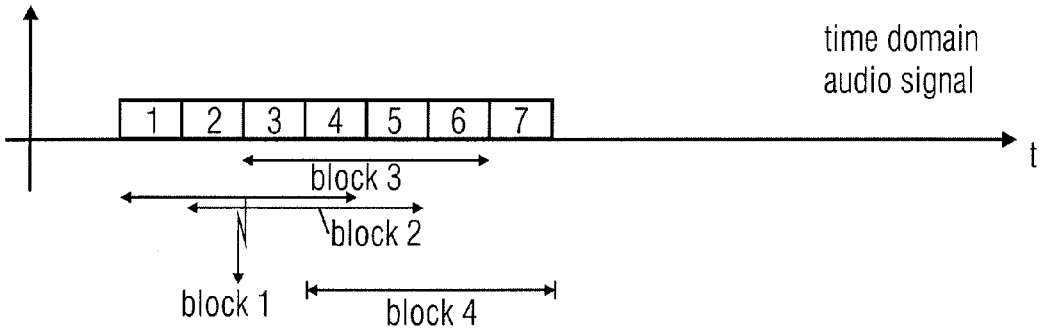
| block 1 | block 2 | block 3 | block 4 | |
|---|---|---|---|---|
| carrier AM/FM portions 2,3 | carrier AM/FM portions 3,4 | carrier AM/FM portions 4,5 | carrier AM/FM portions 5,6 | bit stream |
→ remaining portions, e.g. 1,4, for block 1 are not transmitted or are discarded at receiver
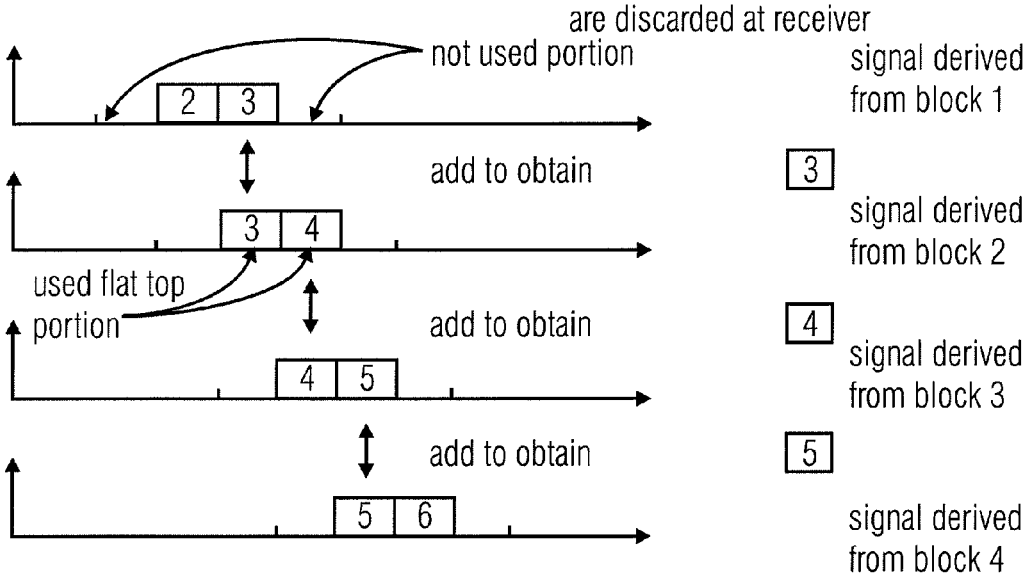
FIG 4C Spectrogram of the original classical music item Spectrogram of the synthesized carriers item Spectrogram of the carriers refined by coarse AM and FM Spectrogram of the carriers refined by coarse AM and FM, and added "grace" noise Spectrogram of the carriers and unprocessed AM and FM

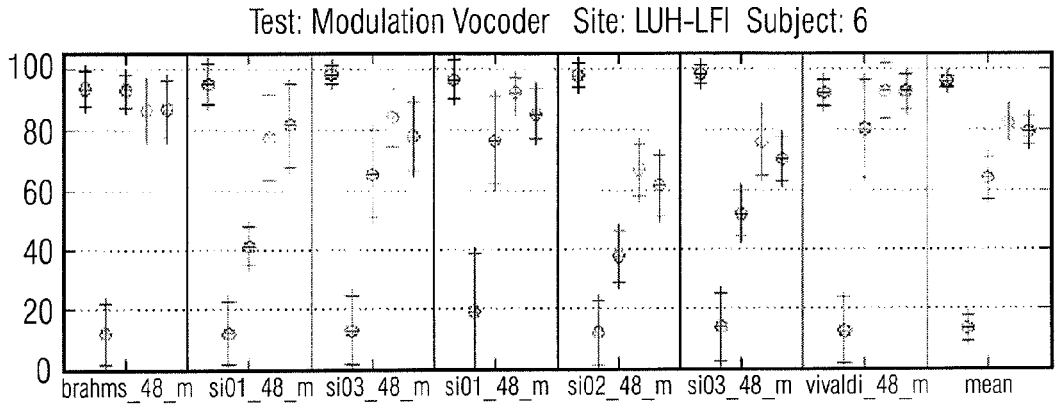

- hidden_reference
- 3k5Hz_reference
- coarceAM_noise_coarseFM
- full AM_coarseFM
- fullAM_fullFM Subjective audio quality test result (MUSHRA)

Test Items

| Item | Description |
|---|---|
| vivaldi_48_m | Classical orchestral music |
| brahms_48_m | Classical orchestral music |
| si01_48_m | Harpsichord/MPEG |
| si03_48_m | Pitch pipe/MPEG |
| sm01_48_m | Bagpipe/MPEG |
| sm02_48_m | Glockenspiel/MPEG |
| sm03_48_m | Plucked string/MPEG |

Configurations under test

| File name extension | Processing method |
|---|---|
| hidden_reference | Hidden reference |
| 3k5Hz | Lower anchor |
| fullAM_fullFM | No modulation processing |
| fullAM_coarseFM | Coarse FM information |
| coarseAM_noise_coarseFM | Coarse FM and AM information with added 'grace' noise |

FIG 8

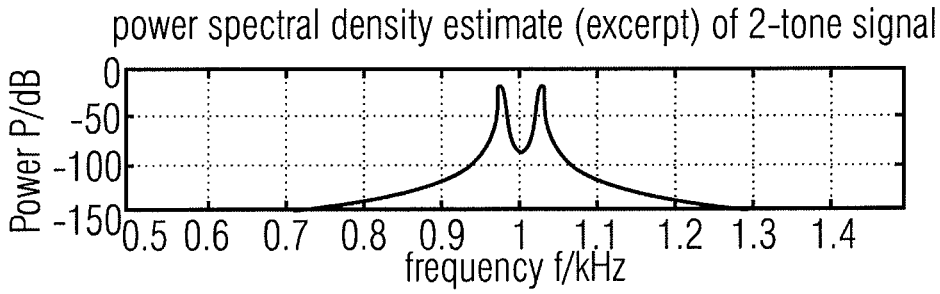
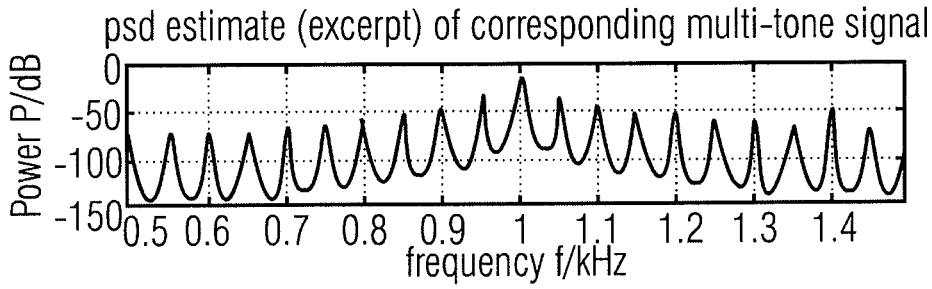
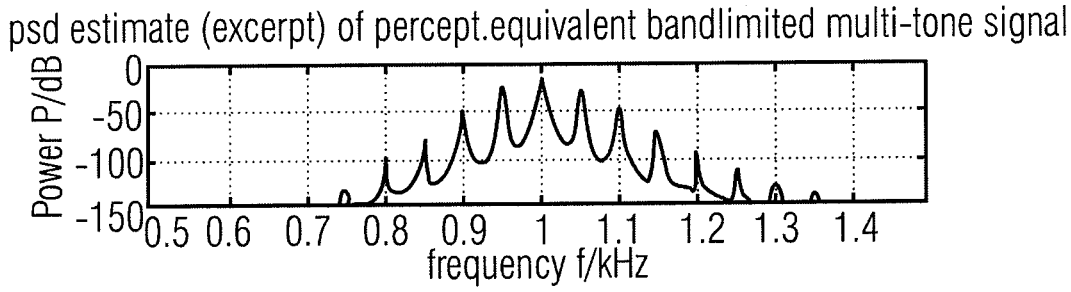
FIG 9A $$s_t(t) = \sin(2\ f_1 t) + \sin(2\ f_2 t)$$

$$s_m(t) = 2\sin\left(2\ \frac{f_1 + f_2}{2}\,t\right) \cdot \left|\cos\left(2\ \frac{f_1 - f_2}{2}\,t\right)\right|$$

APPARATUS AND METHOD FOR CONVERTING AN AUDIO SIGNAL INTO A PARAMETERIZED REPRESENTATION USING BAND PASS FILTERS, APPARATUS AND METHOD FOR MODIFYING A PARAMETERIZED REPRESENTATION USING BAND PASS FILTER, APPARATUS AND METHOD FOR SYNTHESIZING A PARAMETERIZED OF AN AUDIO SIGNAL USING BAND PASS FILTERS

CROSS-REFERENCE TO RELATED APPLICATION

This application is a U.S. National Phase entry of PCT/EP2009/001707 filed Mar. 10, 2009, and claims priority to U.S. Patent Application No. 61/038,300 filed Mar. 20, 2008 and European Patent Application No. 08015123.6 filed Aug. 27, 2008, each of which is incorporated herein by references hereto.

BACKGROUND OF THE INVENTION

The present invention is related to audio coding and, in particular, to parameterized audio coding schemes, which are applied in vocoders.

One class of vocoders is phase vocoders. A tutorial on phase vocoders is the publication "The Phase Vocoder: A tutorial", Mark Dolson, Computer Music Journal, Volume 10, No. 4, pages 14 to 27, 1986. An additional publication is "New phase vocoder techniques for pitch-shifting, harmonizing and other exotic effects", L. Laroche and M. Dolson, proceedings 1999, IEEE workshop on applications of signal processing to audio and acoustics, New Paltz, N.Y., Oct. 17 to 20, 1999, pages 91 to 94.

FIGS. 5 to 6 illustrate different implementations and applications for a phase vocoder. FIG. 5 illustrates a filter bank implementation of a phase vocoder, in which an audio signal is provided at an input 500, and where, at an output 510, a synthesized audio signal is obtained. Specifically, each channel of the filter bank illustrated in FIG. 5 comprises a band pass filter 501 and a subsequently connected oscillator 502. Output signals of all oscillators 502 from all channels are combined via a combiner 503, which is illustrated as an adder. At the output of the combiner 503, the output signal 510 is obtained.

Each filter 501 is implemented to provide, on the one hand, an amplitude signal A(t), and on the other hand, the frequency signal f(t). The amplitude signal and the frequency signal are time signals. The amplitude signal illustrates a development of the amplitude within a filter band over time and the frequency signal illustrates the development of the frequency of a filter output signal over time.

As schematic implementation of a filter 501 is illustrated in FIG. 6. The incoming signal is routed into two parallel paths. In one path, the signal is multiplied by a sign wave with an amplitude of 1.0 and a frequency equal to the center frequency of the band pass filter as illustrated at 551. In the other path, the signal is multiplied by a cosine wave of the same amplitude and frequency as illustrated at 551. Thus, the two parallel paths are identical except for the phase of the multiplying wave form. Then, in each path, the result of the multiplication is fed into a low pass filter 553. The multiplication operation itself is also known as a simple ring modulation. Multiplying any signal by a sine (or cosine) wave of constant frequency has the effect of simultaneously shifting all the frequency components in the original signal by both plus and minus the frequency of the sine wave. If this result is now passed through an appropriate low pass filter, only the low frequency portion will remain. This sequence of operations is also known as heterodyning. This heterodyning is performed in each of the two parallel paths, but since one path heterodynes with a sine wave, while the other path uses a cosine wave, the resulting heterodyned signals in the two paths are out of phase by 90°. The upper low pass filter 553, therefore, provides a quadrate signal 554 and the lower filter 553 provides an in-phase signal. These two signals, which are also known as I and Q signals, are forwarded into a coordinate transformer 556, which generates a magnitude/phase representation from the rectangular representation.

The amplitude signal is output at 557 and corresponds to A(t) from FIG. 5. The phase signal is input into a phase unwrapper 558. At the output of element 558 there does not exist a phase value between 0 and 360° but a phase value, which increases in a linear way. This "unwrapped" phase value is input into a phase/frequency converter 559 which may, for example, be implemented as a phase-difference-device which subtracts a phase at a preceding time instant from phase at a current time instant in order to obtain the frequency value for the current time instant.

This frequency value is added to a constant frequency value $f_i$ of the filter channel i, in order to obtain a time-varying frequency value at an output 560.

The frequency value at the output 560 has a DC portion $f_i$ and a changing portion, which is also known as the "frequency fluctuation", by which a current frequency of the signal in the filter channel deviates from the center frequency $f_i$.

Thus, the phase vocoder as illustrated in FIG. 5 and FIG. 6 provides a separation of spectral information and time information. The spectral information is comprised in the location of the specific filter bank channel at frequency $f_i$, and the time information is in the frequency fluctuation and in the magnitude over time.

Another description of the phase vocoder is the Fourier transform interpretation. It consists of a succession of overlapping Fourier transforms taken over finite-duration windows in time. In the Fourier transform interpretation, attention is focused on the magnitude and phase values for all of the different filter bands or frequency bins at the single point in time. While in the filter bank interpretation, the re-synthesis can be seen as a classic example of additive synthesis with time varying amplitude and frequency controls for each oscillator, the synthesis, in the Fourier implementation, is accomplished by converting back to real-and-imaginary form and overlap-adding the successive inverse Fourier transforms. In the Fourier interpretation, the number of filter bands in the phase vocoder is the number of frequency points in the Fourier transform. Similarly, the equal spacing in frequency of the individual filters can be recognized as the fundamental feature of the Fourier transform. On the other hand, the shape of the filter pass bands, i.e., the steepness of the cutoff at the band edges is determined by the shape of the window function which is applied prior to calculating the transform. For a particular characteristic shape, e.g., Hamming window, the steepness of the filter cutoff increases in direct proportion to the duration of the window.

It is useful to see that the two different interpretations of the phase vocoder analysis apply only to the implementation of the bank of band pass filters. The operation by which the outputs of these filter are expressed as time-varying amplitudes and frequencies is the same for both implementations. The basic goal of the phase vocoder is to separate temporal information from spectral information. The operative strategy is to divide the signal into a number of spectral bands and to characterize the time-varying signal in each band.

Two basic operations are particularly significant. These operations are time scaling and pitch transposition. It is possible to slow down a recorded sound simply by playing it back at a lower sample rate. This is analogous to playing a tape recording at a lower playback speed. But, this kind of simplistic time expansion simultaneously lowers the pitch by the same factor as the time expansion. Slowing down the temporal evolution of a sound without altering its pitch necessitates an explicit separation of temporal and spectral information. As noted above, this is precisely what the phase vocoder attempts to do. Stretching out the time-varying amplitude and frequency signals A(t) and f(t) to FIG. 5*a* does not change the frequency of the individual oscillators at all, but it does slow down the temporal evolution of the composite sound. The result is a time-expanded sound with the original pitch. The Fourier transform view of time scaling is so that, in order to time-expand a sound, the inverse FFTs can simply be spaced further apart than the analysis FFTs. As a result, spectral changes occur more slowly in the synthesized sound than in the original in this application, and the phase is rescaled by precisely the same factor by which the sound is being time-expanded.

The other application is pitch transposition. Since the phase vocoder can be used to change the temporal evolution of a sound without changing its pitch, it should also be possible to do the reverse, i.e., to change the pitch without changing the duration. This is either done by time-scale using the desired pitch-change factor and then to play the resulting sounds back at the wrong sample rate or to down-sample by a desired factor and playback at unchanged rate. For example, to raise the pitch by an octave, the sound is first time-expanded by a factor of 2 and the time-expansion is then played at twice the original sample rate.

The vocoder (or 'VODER') was invented by Dudley as a manually operated synthesizer device for generating human speech [2]. Some considerable time later the principle of its operation was extended towards the so-called phase vocoder [3] [4]. The phase vocoder operates on overlapping short time DFT spectra and hence on a set of sub band filters with fixed center frequencies. The vocoder has found wide acceptance as an underlying principle for manipulating audio files. For instance, audio effects like time-stretching and pitch transposing are easily accomplished by a vocoder [5]. Since then, a lot of modifications and improvements to this technology have been published. Specifically the constraints of having fixed frequency analysis filters was dropped by adding a fundamental frequency ('f0') derived mapping, for example in the 'STRAIGHT' vocoder [6]. Still, the prevalent use case remained to be speech coding/processing.

Another area of interest for the audio processing community has been the decomposition of speech signals into modulated components. Each component consists of a carrier, an amplitude modulation (AM) and a frequency modulation (FM) part of some sort. A signal adaptive way of such decomposition was published e.g. in [7] suggesting the use of a set of signal adaptive band pass filters. In [8] an approach that utilizes AM information in combination with a 'sinusoids plus noise' parametric coder was presented. Another decomposition method was published in [9] using the so-called 'FAME' strategy: here, speech signals have been decomposed into four bands using band pass filters in order to subsequently extract their AM and FM content. Most recent publications also aim at reproducing audio signals from AM information (sub band envelopes) alone and suggest iterative methods for recovery of the associated phase information which predominantly contains the FM [10].

Our approach presented herein is targeting at the processing of general audio signals hence also including music. It is similar to a phase vocoder but modified in order to perform a signal dependent perceptually motivated sub band decomposition into a set of sub band carrier frequencies with associated AM and FM signals each. We like to point out that this decomposition is perceptually meaningful and that its elements are interpretable in a straight forward way, so that all kinds of modulation processing on the components of the decomposition become feasible.

To achieve the goal stated above, we rely on the observation that perceptually similar signals exist. A sufficiently narrow-band tonal band pass signal is perceptually well represented by a sinusoidal carrier at its spectral 'center of gravity' (COG) position and its Hilbert envelope. This is rooted in the fact that both signals approximately evoke the same movement of the basilar membrane in the human ear [11]. A simple example to illustrate this is the two-tone complex (1) with frequencies $f_1$ and $f_2$ sufficiently close to each other so that they perceptually fuse into one (over-) modulated component $$s_1(t)=\sin(2\pi f_1 t)+\sin(2\pi f_2 t) \tag{1}$$

A signal consisting of a sinusoidal carrier at a frequency equal to the spectral COG of $s_t$ and having the same absolute amplitude envelope as $s_t$ is $s_m$ according to (2)

$$s_m(t) = 2\sin\left(2\pi\frac{f_1+f_2}{2}t\right)\cdot\left|\cos\left(2\pi\frac{|f_1-f_2|}{2}t\right)\right| \tag{2}$$

In FIG. 9*b* (top and middle plot) the time signal and the Hilbert envelope of both signals are depicted. Note the phase jump of $\pi$ in the first signal at zeros of the envelope as opposed to the second signal. FIG. 9*a* displays the power spectral density plots of the two signals (top and middle plot).

Although these signals are considerably different in their spectral content their predominant perceptual cues—the 'mean' frequency represented by the COG, and the amplitude envelope—are similar. This makes them perceptually mutual substitutes with respect to a band-limited spectral region centered at the COG as depicted in FIG. 9*a* and FIG. 9*b* (bottom plots). The same principle still holds true approximately for more complicated signals.

Generally, modulation analysis/synthesis systems that decompose a wide-band signal into a set of components each comprising carrier, amplitude modulation and frequency modulation information have many degrees of freedom since, in general, this task is an ill-posed problem. Methods that modify subband magnitude envelopes of complex audio spectra and subsequently recombine them with their unmodified phases for re-synthesis do result in artifacts, since these procedures do not pay attention to the final receiver of the sound, i.e., the human ear.

Furthermore, applying very long FFTs, i.e., very long windows in order to obtain a fine frequency resolution concurrently reduces the time resolution. On the other hand transient signals would not require a high frequency resolution, but would necessitate a high time resolution, since, at a certain time instant the band pass signals exhibit strong mutual correlation, which is also known as the "vertical coherence". In this terminology, one imagines a time-spectrogram plot where in the horizontal axis, the time variable is used and where in the vertical axis, the frequency variable is used. Processing transient signals with a very high frequency resolution will, therefore, result in a low time resolution, which, at the same time means an almost complete loss of the vertical coherence. Again, the ultimate receiver of the sound, i.e., the human ear is not considered in such a model.

The publication [22] discloses an analysis methodology for extracting accurate sinusoidal parameters from audio signals. The method combines modified vocoder parameter estimation with currently used peak detection algorithms in sinusoidal modeling. The system processes input frame by frame, searches for peaks like a sinusoidal analysis model but also dynamically selects vocoder channels through which smeared peaks in the FFT domain are processed. This way, frequency trajectories of sinusoids of changing frequency within a frame may be accurately parameterized. In a spectral parsing step, peaks and valleys in the magnitude FFT are identified. In a peak isolation, the spectrum is set to zero outside the peak of interest and both the positive and negative frequency versions of the peak are retained. Then, the Hilbert transform of this spectrum is calculated and, subsequently, the IFFT of the original and the Hilbert transformed spectra are calculated to obtain two time domain signals, which are 90° out of phase with each other. The signals are used to get the analytic signal used in vocoder analysis. Spurious peaks can be detected and will later be modeled as noise or will be excluded from the model.

Again, perceptual criteria such as a varying band width of the human ear over the spectrum, i.e., such as small band width in the lower part of the spectrum and higher band width in the upper part of the spectrum are not accounted for. Furthermore, a significant feature of the human ear is that, as discussed in connection with FIGS. 9*a*, 9*b* and 9*c* the human ear combines sinusoidal tones within a band width corresponding to the critical band width of the human ear so that a human being does not hear two stable tones having a small frequency difference but perceives one tone having a varying amplitude, where the frequency of this tone is positioned between the frequencies of the original tones. This effect increases more and more when the critical band width of the human ear increases.

Furthermore, the positioning of the critical bands in the spectrum is not constant, but is signal-dependent. It has been found out by psychoacoustics that the human ear dynamically selects the center frequencies of the critical bands depending on the spectrum. When, for example, the human ear perceives a loud tone, then a critical band is centered around this loud tone. When, later, a loud tone is perceived at a different frequency, then the human ear positions a critical band around this different frequency so that the human perception not only is signal-adaptive over time but also has filters having a high spectral resolution in the low frequency portion and having a low spectral resolution, i.e., high band width in the upper part of the spectrum.

SUMMARY

According to an embodiment, an apparatus for converting an audio signal into a parameterized representation may have a signal analyzer for analyzing a portion of the audio signal to acquire an analysis result; a band pass estimator for estimating information of a plurality of band pass filters based on the analysis result, wherein the information on the plurality of band pass filters has information on a filter shape for the portion of the audio signal, wherein the band width of a band pass filter is different over an audio spectrum and depends on the center frequency of the band pass filter; a modulation estimator for estimating an amplitude modulation or a frequency modulation or a phase modulation for each band of the plurality of band pass filters for the portion of the audio signal using the information on the plurality of band pass filters; and an output interface for transmitting, storing or modifying information on the amplitude modulation, information on the frequency modulation or phase modulation or the information on the plurality of band pass filters for the portion of the audio signal.

According to another embodiment, a method of converting an audio signal into a parameterized representation may have the steps of analyzing a portion of the audio signal to acquire an analysis result; estimating information of a plurality of band pass filters based on the analysis result, wherein the information on the plurality of band pass filters has information on a filter shape for the portion of the audio signal, wherein the band width of a band pass filter is different over an audio spectrum and depends on the center frequency of the band pass filter; estimating an amplitude modulation or a frequency modulation or a phase modulation for each band of the plurality of band pass filters for the portion of the audio signal using the information on the plurality of band pass filters; and transmitting, storing or modifying information on the amplitude modulation, information on the frequency modulation or phase modulation or the information on the plurality of band pass filters for the portion of the audio signal.

According to an embodiment, an apparatus for modifying a parameterized representation having, for a time portion of an audio signal, band pass filter information for a plurality of band pass filters, the band pass filter information indicating time-varying band pass filter center frequencies of band pass filters having band widths, which depend on a band pass filter center frequency of the corresponding band pass filters, and having amplitude modulation or phase modulation or frequency modulation information for each band pass filter for the time portion of the audio signal, the modulation information being related to the center frequencies of the band pass filters, may have a modifier for modifying the time varying center frequencies or for modifying the amplitude modulation or phase modulation or frequency modulation information and for generating a modified parameterized representation, in which the band widths of the band pass filters depend on the band pass filter center frequencies of the corresponding band pass filters.

According to another embodiment, an apparatus for modifying a parameterized representation having, for a time portion of an audio signal, band pass filter information for a plurality of band pass filters, the band pass filter information indicating time-varying band pass filter center frequencies of band pass filters having band widths, which depend on a band pass filter center frequency of the corresponding band pass filters, and having amplitude modulation or phase modulation or frequency modulation information for each band pass filter for the time portion of the audio signal, the modulation information being related to the center frequencies of the band pass filters, may execute the step of modifying the time varying center frequencies or modifying the amplitude modulation or phase modulation or frequency modulation information and generating a modified parameterized representation, in which the band widths of the band pass filters depend on the band pass filter center frequencies of the corresponding band pass filters.

According to an embodiment, an apparatus for synthesizing a parameterized representation of an audio signal having a time portion of an audio signal, band pass filter information for a plurality of band pass filters, the band pass filter information indicating time-varying band pass filter center frequencies of band pass filters having varying band widths, which depend on a band pass filter center frequency of the corresponding band pass filter, and having amplitude modulation or phase modulation or frequency modulation information for each band pass filter for the time portion of the audio signal may have an amplitude modulation synthesizer for synthesizing an amplitude modulation component based on the amplitude modulation information; a frequency modulation or phase modulation synthesizer for synthesizing instantaneous frequency of phase information based on the information on a carrier frequency and a frequency modulation information for a respective band width, wherein distances in frequency between adjacent carrier frequencies are different over a frequency spectrum, an oscillator for generating an output signal representing an instantaneously amplitude modulated, frequency modulated or phase modulated oscillation signal for each band pass filter channel; and a combiner for combining signals from the band pass filter channels and for generating an audio output signal based on the signals from the band pass filter channels.

According to another embodiment, a method of synthesizing a parameterized representation of an audio signal having a time portion of an audio signal, band pass filter information for a plurality of band pass filters, the band pass filter information indicating time-varying band pass filter center frequencies of band pass filters having varying band widths, which depend on a band pass filter center frequency of the corresponding band pass filter, and having amplitude modulation or phase modulation or frequency modulation information for each band pass filter for the time portion of the audio signal may have the steps of synthesizing an amplitude modulation component based on the amplitude modulation information; synthesizing instantaneous frequency or phase information based on the information on a carrier frequency and a frequency modulation information for a respective band width, wherein distances in frequency between adjacent carrier frequencies are different over a frequency spectrum, generating an output signal representing an instantaneously amplitude modulated, frequency modulated or phase modulated oscillation signal for each band pass filter channel; and combining signals from the band pass filter channels and for generating an audio output signal based on the signals from the band pass filter channels.

One embodiment may be a parametric representation for an audio signal, the parametric representation being related to a time portion of an audio signal, band pass filter information for a plurality of band pass filters, the band pass filter information indicating time-varying band pass filter center frequencies of band pass filters having varying band widths, which depend on a band pass filter center frequency of the corresponding band pass filter, and having amplitude modulation or phase modulation or frequency modulation information for each band pass filter for the time portion of the audio signal.

One embodiment may be a computer program for performing, when running on a computer, a method in accordance with one of the above mentioned methods.

The present invention is based on the finding that the variable band width of the critical bands can be advantageously utilized for different purposes. One purpose is to improve efficiency by utilizing the low resolution of the human ear. In this context, the present invention seeks to not calculate the data where the data is not required in order to enhance efficiency.

The second advantage, however, is that, in the region, where a high resolution is necessitated, the data is calculated in order to enhance the quality of a parameterized and, again, re-synthesized signal.

The main advantage, however, is in the fact, that this type of signal decomposition provides a handle for signal manipulation in a straight forward, intuitive and perceptually adapted way, e.g. for directly addressing properties like roughness, pitch, etc.

To this end, a signal-adaptive analysis of the audio signal is performed and, based on the analysis results, a plurality of bandpass filters are estimated in a signal-adaptive manner. Specifically, the bandwidths of the bandpass filters are not constant, but depend on the center frequency of the bandpass filter. Therefore, the present invention allows varying bandpass-filter frequencies and, additionally, varying bandpass-filter bandwidths, so that, for each perceptually correct bandpass signal, an amplitude modulation and a frequency modulation together with a current center frequency, which approximately is the calculated bandpass center frequency are obtained. The frequency value of the center frequency in a band represents the center of gravity (COG) of the energy within this band in order to model the human ear as far as possible. Thus, a frequency value of a center frequency of a bandpass filter is not necessarily selected to be on a specific tone in the band, but the center frequency of a bandpass filter may easily lie on a frequency value, where a peak did not exist in the FFT spectrum.

The frequency modulation information is obtained by down mixing the band pass signal with the determined center frequency. Thus, although the center frequency has been determined with a low time resolution due to the FFT-based (spectral-based) determination, the instantaneous time information is saved in the frequency modulation. However, the separation of the long-time variation into the carrier frequency and the short-time variation into the frequency modulation information together with the amplitude modulation allows the vocoder-like parameterized representation in a perceptually correct sense.

Thus, the present invention is advantageous in that the condition is satisfied that the extracted information is perceptually meaningful and interpretable in a sense that modulation processing applied on the modulation information should produce perceptually smooth results avoiding undesired artifacts introduced by the limitations of the modulation representation itself.

An other advantage of the present invention is that the extracted carrier information alone already allows for a coarse, but perceptually pleasant and representative "sketch" reconstruction of the audio signal and any successive application of AM and FM related information should refine this representation towards full detail and transparency, which means that the inventive concept allows full scalability from a low scaling layer relying on the "sketch" reconstruction using the extracted carrier information only, which is already perceptually pleasant, until a high quality using additional higher scaling layers having the AM and FM related information in increasing accuracy/time resolution.

An advantage of the present invention is that it is highly desirable for the development of new audio effects on the one hand and as a building block for future efficient audio compression algorithms on the other hand. While, in the past, there has been a distinction between parametric coding methods and waveform coding, this distinction can be bridged by the present invention to a large extent. While waveform coding methods scale easily up to transparency provided the bit rate is available, parametric coding schemes, such as CELP or ACELP schemes are subjected to the limitations of the underlying source models, and even if the bit rate is increased more and more in these coders, they can not approach transparency. However, parametric methods usually offer a wide range of manipulation possibilities, which can be exploited for an application of audio effects, while wave-form coding is strictly limited to the best as possible reproduction of the original signal.

The present invention will bridge this gap by enabling a seamless transition between both approaches.

BRIEF DESCRIPTION OF THE DRAWINGS

Subsequently, the embodiments of the present invention are discussed in the context of the attached drawings, in which:

FIG. 4*c* illustrates a representation of an overlapping the processed time-domain audio signal, bit stream of the audio signal and an overlap/add procedure for modulation information synthesis;

FIG. 8 illustrates a result of a subjective audio quality test;

FIG. 9*a* illustrates a power spectral density of a 2-tone signal, a multi-tone signal and an appropriately band-limited multi-tone signal;

DETAILED DESCRIPTION OF THE INVENTION

Figure 1A:
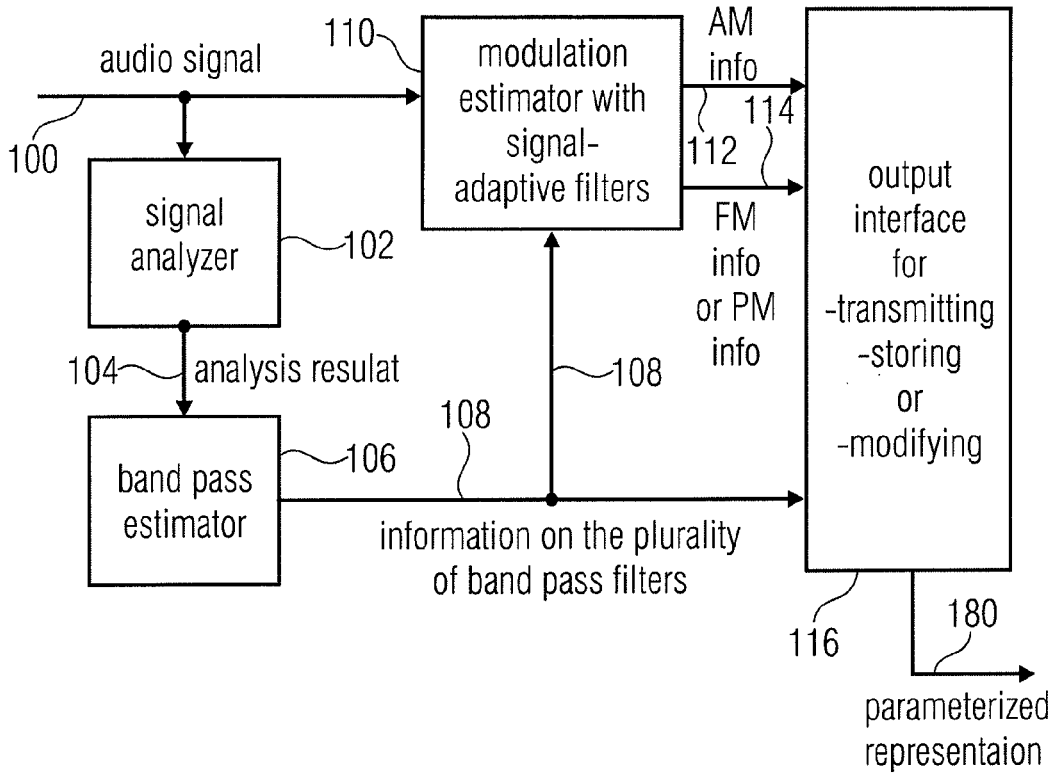
FIG. 1 is a schematic representation of an embodiment of an apparatus or method for converting an audio signal.
FIG. 1*b* is a schematic representation of another embodiment.

FIG. 1 illustrates an apparatus for converting an audio signal 100 into a parameterized representation 180. The apparatus comprises a signal analyzer 102 for analyzing a portion of the audio signal to obtain an analysis result 104. The analysis result is input into a band pass estimator 106 for estimating information on a plurality of band pass filters for the audio signal portion based on the signal analysis result. Thus, the information 108 on the plurality of band-pass filters is calculated in a signal-adaptive manner.

Specifically, the information 108 on the plurality of band-pass filters comprises information on a filter shape. The filter shape can include a bandwidth of a band-pass filter and/or a center frequency of the band-pass filter for the portion of the audio signal, and/or a spectral form of a magnitude transfer function in a parametric form or a non-parametric form. Importantly, the bandwidth of a band-pass filter is not constant over the whole frequency range, but depends on the center frequency of the band-pass filter. The dependency is so that the bandwidth increases to higher center frequencies and decreases to lower center frequencies. Even more advantagous, the bandwidth of a band-pass filter is determined in a fully perceptually correct scale, such as the bark scale, so that the bandwidth of a band-pass filter is dependent on the bandwidth actually performed by the human ear for a certain signal-adaptively determined center frequency.

To this end, it is advantageous that the signal analyzer 102 performs a spectral analysis of a signal portion of the audio signal and, particularly, analyses the power distribution in the spectrum to find regions having a power concentration, since such regions are determined by the human ear as well when receiving and further processing sound.

The inventive apparatus additionally comprises a modulation estimator 110 for estimating an amplitude modulation 112 or a frequency modulation 114 for each band of the plurality of band-pass filters for the portion of the audio signal. To this end, the modulation estimator 110 uses the information on the plurality of band-pass filters 108 as will be discussed later on.

The inventive apparatus of FIG. 1*a* additionally comprises an output interface 116 for transmitting, storing or modifying the information on the amplitude modulation 112, the information of the frequency modulation 114 or the information on the plurality of band-pass filters 108, which may comprise filter shape information such as the values of the center frequencies of the band-pass filters for this specific portion/block of the audio signal or other information as discussed above. The output is a parameterized representation 180 as illustrated in FIG. 1*a*.

Figure 1B:
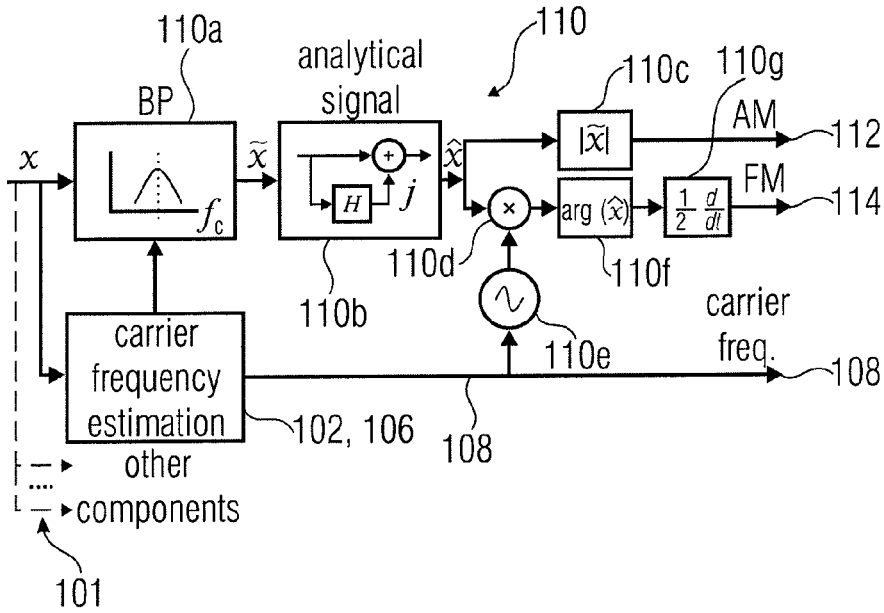

FIG. 1*d* illustrates an embodiment of the modulation estimator 110 and the signal analyzer 102 of FIG. 1*a* and the band-pass estimator 106 of FIG. 1*a* combined into a single unit, which is called "carrier frequency estimation" in FIG. 1*b*. The modulation estimator 110 comprises a band-pass filter 110*a*, which provides a band-pass signal. This is input into an analytical signal converter 110*b*. The output of block 110*b* is useful for calculating AM information and FM information. For calculating the AM information, the magnitude of the analytical signal is calculated by block 110*c*. The output of the analytical signal block 110*b* is input into a multiplier 110*d*, which receives, at its other input, an oscillator signal from an oscillator 110*e*, which is controlled by the actual carrier frequency $f_c$ of the band pass 110*a*. Then, the phase of the multiplier output is determined in block 110*f*. The instantaneous phase is differentiated at block 110*g* in order to finally obtain the FM information.

Thus, the decomposition into carrier signals and their associated modulations components is illustrated in FIG. 1*b*.

In the picture the signal flow for the extraction of one component is shown. All other components are obtained in a similar fashion. The extraction is carried out on a block-by-block basis using a block size of $N=2^{14}$ at 48 kHz sampling frequency and ¾ overlap, roughly corresponding to a time interval of 340 ms and a stride of 85 ms. Note that other block sizes or overlap factors may also be used. It consists of a signal adaptive band pass filter that is centered at a local COG [12] in the signal's DFT spectrum. The local COG candidates are estimated by searching positive-to-negative transitions in the CogPos function defined in (3). A post-selection procedure ensures that the final estimated COG positions are approximately equidistant on a perceptual scale.

$$CogPos(k, m) = \frac{nom(k, m)}{denom(k, m)} \tag{3}$$

$$nom(k, m) = \alpha \sum_{i=-B(k)/2}^{+B(k)/2} (iw(i)|X(k+i, m)|^2) + (1-\alpha)nom(k, m-1)$$

$$denom(k, m) = \alpha \sum_{i=-B(k)/2}^{+B(k)/2} (w(i)|X(k+i, m)|^2) + (1-\alpha)denom(k, m-1)$$

$$\alpha = \frac{1}{\tau F_s};\ i \in \square$$

For every spectral coefficient index k it yields the relative offset towards the local center of gravity in the spectral region that is covered by a smooth sliding window w. The width B(k) of the window follows a perceptual scale, e.g. the Bark scale. X(k,m) is the spectral coefficient k in time block m. Additionally, a first order recursive temporal smoothing with time constant τ is done.

Alternative center of gravity value calculating functions are conceivable, which can be iterative or non-iterative. A non-iterative function for example includes an adding energy values for different portions of a band and by comparing the results of the addition operation for the different portions.

The local COG corresponds to the 'mean' frequency that is perceived by a human listener due to the spectral contribution in that frequency region. To see this relationship, note the equivalence of COG and 'intensity weighted average instantaneous frequency' (IWAIF) as derived in [12]. The COG estimation window and the transition bandwidth of the resulting filter are chosen with regard to resolution of the human ear ('critical bands'). Here, a bandwidth of approx. 0.5 Bark was found empirically to be a good value for all kinds of test items (speech, music, ambience). Additionally, this choice is supported by the literature [13].

Subsequently, the analytic signal is obtained using the Hilbert transform of the band pass filtered signal and heterodyned by the estimated COG frequency. Finally the signal is further decomposed into its amplitude envelope and its instantaneous frequency (IF) track yielding the desired AM and FM signals. Note that the use of band pass signals centered at local COG positions correspond to the 'regions of influence' paradigm of a traditional phase vocoder. Both methods preserve the temporal envelope of a band pass signal: The first one intrinsically and the latter one by ensuring local spectral phase coherence.

Care has to be taken that the resulting set of filters on the one hand covers the spectrum seamlessly and on the other hand adjacent filters do not overlap too much since this will result in undesired beating effects after the synthesis of (modified) components. This involves some compromises with respect to the bandwidth of the filters that follow a perceptual scale but, at the same time, have to provide seamless spectral coverage. So the carrier frequency estimation and signal adaptive filter design turn out to be the crucial parts for the perceptual significance of the decomposition components and thus have strong influence on the quality of the re-synthesized signal. An example of such a compensative segmentation is shown in FIG. 2*c*.

Figure 2A:
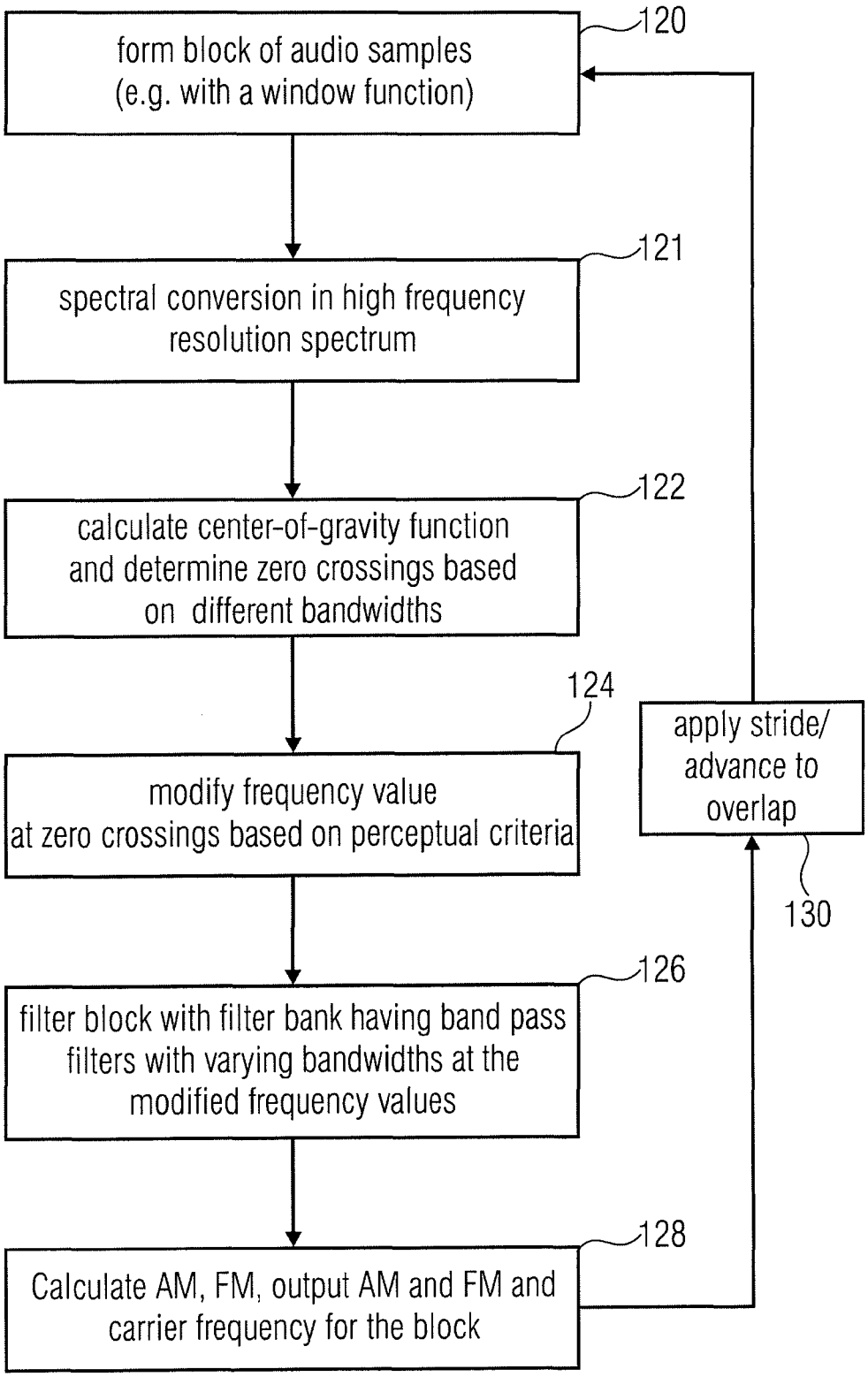
FIG. 2*a* is a flow chart for illustrating a processing operation in the context of the FIG. 1*a* embodiment.
Figure 2B:
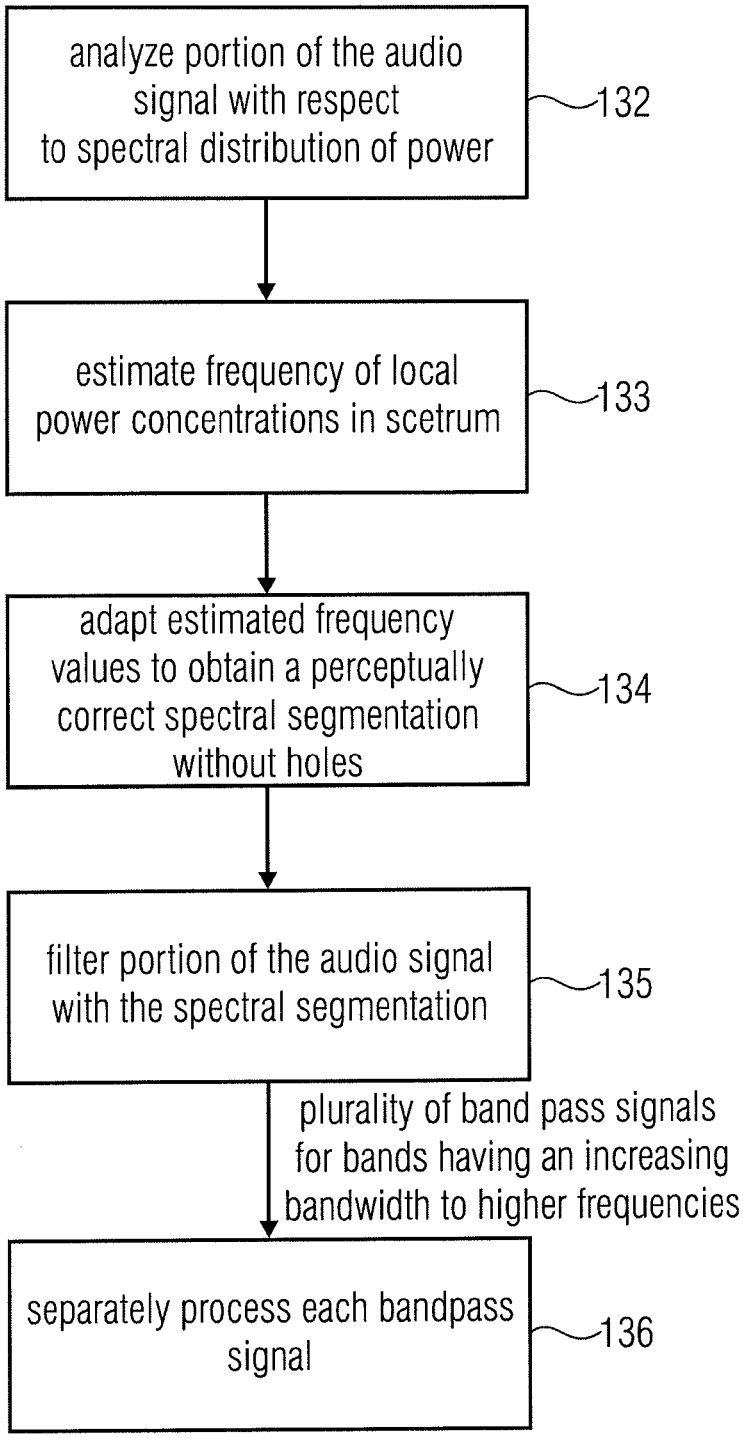
FIG. 2*b* is a flow chart for illustrating the operation process for generating the plurality of band pass signals in an embodiment.
Figure 2C:
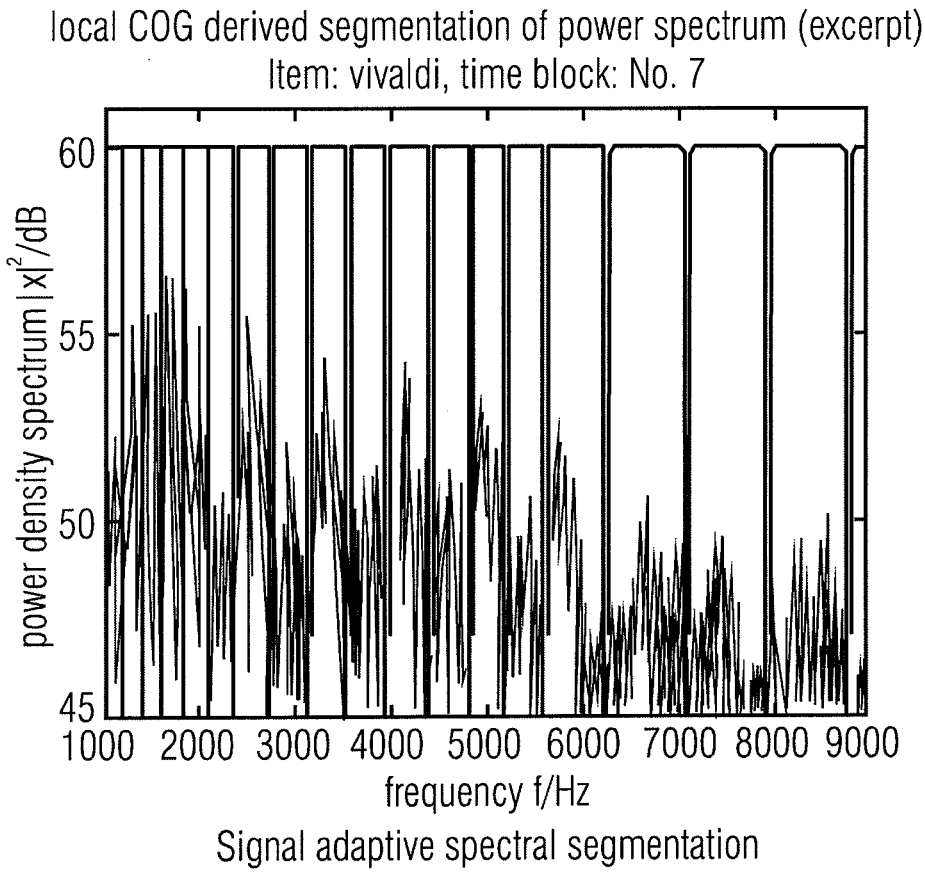
FIG. 2*c* illustrates a signal-adaptive spectral segmentation based on the COG calculation and perceptual constraints.

FIG. 2*a* illustrates a process for converting an audio signal into a parameterized representation as illustrated in FIG. 2*b*. In a first step 120, blocks of audio samples are formed. To this end, a window function is used. However, the usage of a window function is not necessary in any case. Then, in step 121, the spectral conversion into a high frequency resolution spectrum 121 is performed. Then, in step 122, the center-of-gravity function is calculated using equation (3). This calculation will be performed in the signal analyzer 102 and the subsequently determined zero crossings will be the analysis result 104 provided from the signal analyzer 102 of FIG. 1*a* to the band-pass estimator 106 of FIG. 1*a*.

As it is visible from equation (3), the center of gravity function is calculated based on different bandwidths. Specifically, the bandwidth B(k), which is used in the calculation for the nominator nom(k,m) and the denominator (k,m) in equation (3) is frequency-dependent. The frequency index k, therefore, determines the value of B and, even more advantageous, the value of B increases for an increasing frequency index k. Therefore, as it becomes clear in equation (3) for nom(k,m), a "window" having the window width B in the spectral domain is centered around a certain frequency value k, where i runs from −B(k)/2 to +B(k)/2.

This index i, which is multiplied to a window w(i) in the nom term makes sure that the spectral power value $X^2$ (where X is a spectral amplitude) to the left of the actual frequency value k enters into the summing operation with a negative sign, while the squared spectral values to the right of the frequency index k enter into the summing operation with the positive sign. Naturally, this function could be different, so that, for example, the upper half enters with a negative sign and the lower half enters with a positive sign. The function B(k) make sure that a perceptually correct calculation of a center of gravity takes place, and this function is determined, for example as illustrated in FIG. 2*c*, where a perceptually correct spectral segmentation is illustrated.

In an alternative implementation, the spectral values X(k) are transformed into a logarithmic domain before calculating the center of gravity function. Then, the value B in the term for the nominator and the denominator in equation (3) is independent of the (logarithmic scale) frequency. Here, the perceptually correct dependency is already included in the spectral values X, which are, in this embodiment, present in the logarithmic scale. Naturally, an equal bandwidth in a logarithmic scale corresponds to an increasing bandwidth with respect to the center frequency in a non-logarithmic scale.

As soon as the zero crossings and, specifically, the positive-to-negative transitions are calculated in step 122, the post-selection procedure in step 124 is performed. Here, the frequency values at the zero crossings are modified based on perceptual criteria. This modification follows several constraints, which are that the whole spectrum is to be covered and no spectral wholes are allowed. Furthermore, center frequencies of band-pass filters are positioned at center of gravity function zero crossings as far as possible and the positioning of center frequencies in the lower portion of the spectrum is favored with respect to the positioning in the higher portion of the spectrum. This means that the signal adaptive spectral segmentation tries to follow center of gravity results of the step 122 in the lower portion of the spectrum more closely and when, based on this determination, the center of gravities in the higher portion of the spectrum do not coincide with band-pass center frequencies, this offset is accepted.

As soon as the center frequency values and the corresponding widths of the band pass filters are determined, the audio signal block is filtered 126 with the filter bank having band pass filters with varying band widths at the modified frequency values as obtained by step 124. Thus, with respect to the example in FIG. 2*c*, a filter bank as illustrated in the signal-adaptive spectral segmentation is applied by calculating filter coefficients and setting these filter coefficients, and the filter bank is subsequently used for filtering the portion of the audio signal which has been used for calculating these spectral segmentations.

This filtering is performed with a filter bank or a time-frequency transform such as a windowed DFT, subsequent spectral weighting and IDFT, where a single band pass filter is illustrated at 110*a* and the band pass filters for the other components 101 form the filter bank together with the band pass filter 110*a*. Based on the subband signals the AM information and the FM information, i.e., 112, 114 are calculated in step 128 and output together with the carrier frequency for each band pass as the parameterized representation of the block of audio sampling values.

Then, the calculation for one block is completed and in the step 130, a stride or advance value is applied in the time domain in an overlapping manner in order to obtain the next block of audio samples as indicated by 120 in FIG. 2*a*.

Figure 4A:
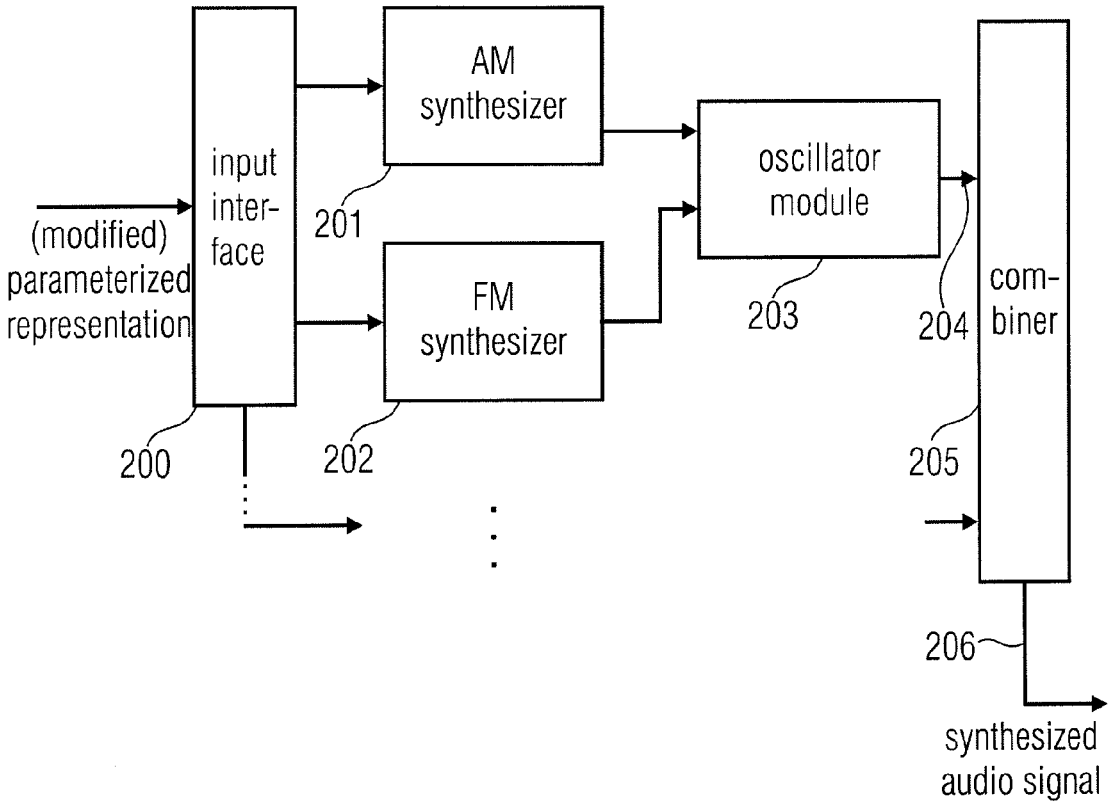
FIG. 4*a* illustrates a schematic representation of the synthesis concept.

This procedure is illustrated in FIG. 4*c*. The time domain audio signal is illustrated in the upper part where exemplarily seven portions, each portion comprising the same number of audio samples are illustrated. Each block consists of N samples. The first block 1 consists of the first four adjacent portions 1, 2, 3, and 4. The next block 2 consists of the signal portions 2, 3, 4, 5, the third block, i.e., block 3 comprises signal portions 3, 4, 5, 6 and the fourth block, i.e., block 4 comprises subsequent signal portions 4, 5, 6 and 7 as illustrated. In the bit stream, step 128 from FIG. 2*a* generates a parameterized representation for each block, i.e., for block 1, block 2, block 3, block 4 or a selected part of the block, advantageously the N/2 middle portion, since the outer portions may contain filter ringing or the roll-off characteristic of a transform window that is designed accordingly. The parameterized representation for each block is transmitted in a bit stream in a sequential manner. In the example illustrated in the upper plot of FIG. 4*c*, a 4-fold overlapping operation is formed. Alternatively, a two-fold overlap could be performed as well so that the stride value or advance value applied in step 130 has two portions in FIG. 4*c* instead of one portion. Basically, an overlap operation is not necessary at all but it is advantageous in order to avoid blocking artifacts and in order to advantageously allow a cross-fade operation from block to block, which is, in accordance with an embodiment of the present invention, not performed in the time domain but which is performed in the AM/FM domain as illustrated in FIG. 4*c*, and as described later on with respect to FIGS. 4*a* and 4*b*.

FIG. 2*b* illustrates a general implementation of the specific procedure in FIG. 2*a* with respect to equation (3). This procedure in FIG. 2*b* is partly performed in the signal analyzer and the band pass estimator. In step 132, a portion of the audio signal is analyzed with respect to the spectral distribution of power. Step 132 may involve a time/frequency transform. In a step 134, the estimated frequency values for the local power concentrations in the spectrum are adapted to obtain a perceptually correct spectral segmentation such as the spectral segmentation in FIG. 2*c*, having a perceptually motivated bandwidths of the different band pass filters and which does not have any holes in the spectrum. In step 135, the portion of the audio signal is filtered with the determined spectral segmentation using the filter bank or a transform method, where an example for a filter bank implementation is given in FIG. 1*b* for one channel having band pass 110*a* and corresponding band pass filters for the other components 101 in FIG. 1*b*. The result of step 135 is a plurality of band pass signals for the bands having an increasing band width to higher frequencies. Then, in step 136, each band pass signal is separately processed using elements 110*a* to 110*g* in the embodiment. However, alternatively, all other methods for extracting an A modulation and an F modulation can be performed to parameterize each band pass signal.

Figure 2D:
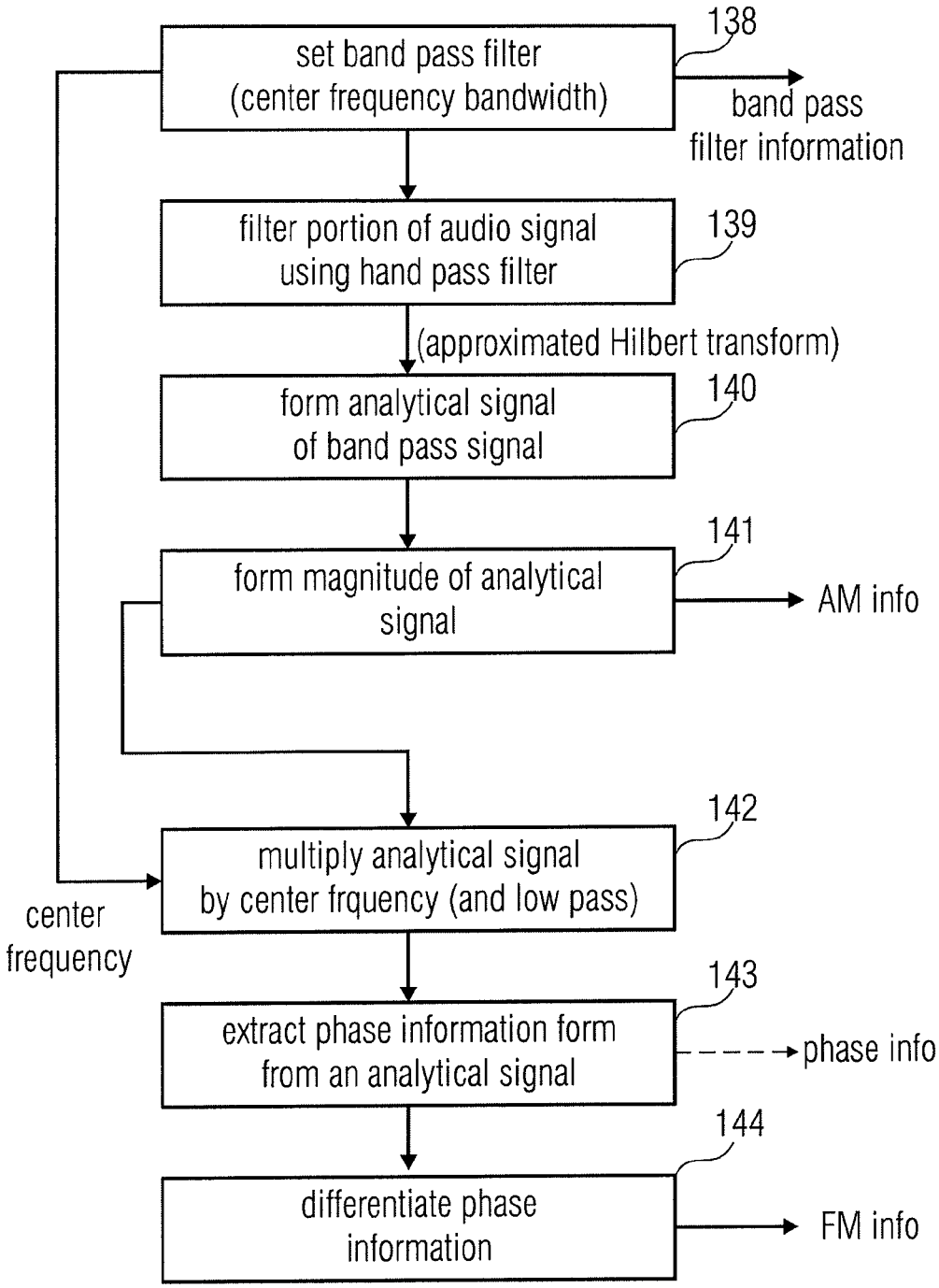
FIG. 2*d* illustrates a flow chart for illustrating the process performed in the context of the FIG. 1*b* embodiment.

Subsequently, FIG. 2*d* will be discussed, in which a sequence of steps for separately processing each band pass signal is illustrated. In a step 138, a band pass filter is set using the calculated center frequency value and using a band width as determined by the spectral segmentation as obtained in step 134 of FIG. 2*b*. This step uses band pass filter information and can also be used for outputting band pass filter information to the output interface 116 in FIG. 1*a*. In step 139, the audio signal is filtered using the band pass filter set in step 138. In step 140, an analytical signal of the band pass signal is formed. Here, the true Hilbert transform or an approximated Hilbert transform algorithm can be applied. This is illustrated by item 110*b* in FIG. 1*b*. Then, in step 141, the implementation of box 110*c* of FIG. 1*b* is performed, i.e., the magnitude of the analytical signal is determined in order to provide the AM information. Basically, the AM information is obtained in the same resolution as the resolution of the band pass signal at the output of block 110*a*. In order to compress this large amount of AM information, any decimation or parameterization techniques can be performed, which will be discussed later on.

In order to obtain phase or frequency information, step 142 comprises a multiplication of the analytical signal by an oscillator signal having the center frequency of the band pass filter. In case of a multiplication, a subsequent low pass filtering operation is to reject the high frequency portion generated by the multiplication in step 142. When the oscillator signal is complex, then, the filtering is not required. Step 142 results in a down mixed analytical signal, which is processed in step 143 to extract the instantaneous phase information as indicated by box 110*f* in FIG. 1*b*. This phase information can be output as parametric information in addition to the AM information, but it is advantageous to differentiate this phase information in box 144 to obtain a true frequency modulation information as illustrated in FIG. 1*b* at 114. Again, the phase information can be used for describing the frequency/phase related fluctuations. When phase information as parameterization information is sufficient, then the differentiation in block 110*g* is not necessary.

Figure 3A:
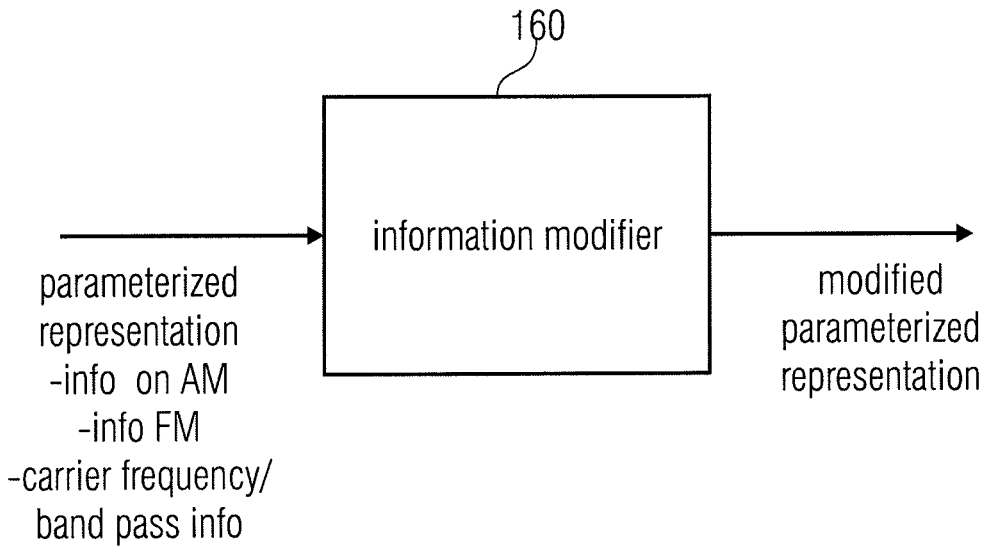
FIG. 3*a* illustrates a schematic representation of an embodiment of a concept for modifying the parameterized representation.

FIG. 3*a* illustrates an apparatus for modifying a parameterized representation of an audio signal that has, for a time portion, band pass filter information from a plurality of band pass filters, such as block 1 in the plot in the middle of FIG. 4*c*.

The band pass filter information indicates time/varying band pass filter center frequencies (carrier frequencies) of band pass filters having band widths which depend on the band pass filters and the frequencies of the band pass filters, and having amplitude modulation or phase modulation or frequency modulation information for each band pass filter for the respective time portion. The apparatus for modifying comprises an information modifier 160 which is operative to modify the time varying center frequencies or to modify the amplitude modulation information or the frequency modulation information or the phase modulation information and which outputs a modified parameterized representation which has carrier frequencies for an audio signal portion, modified AM information, modified PM information or modified FM information.

Figure 3B:
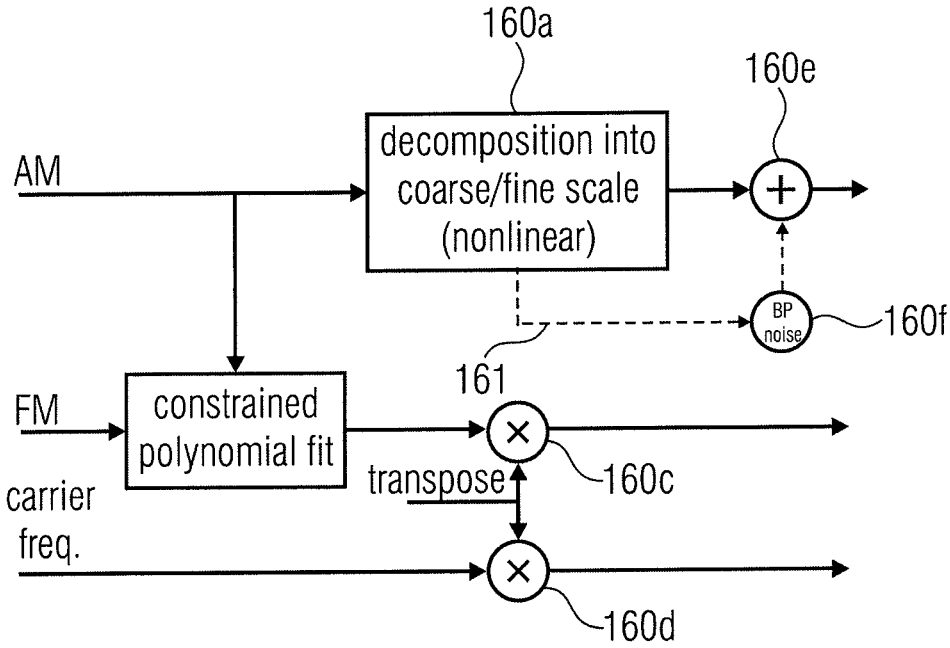
FIG. 3*b* illustrates an embodiment of the concept illustrated in FIG. 3*a;*
Figure 3C:
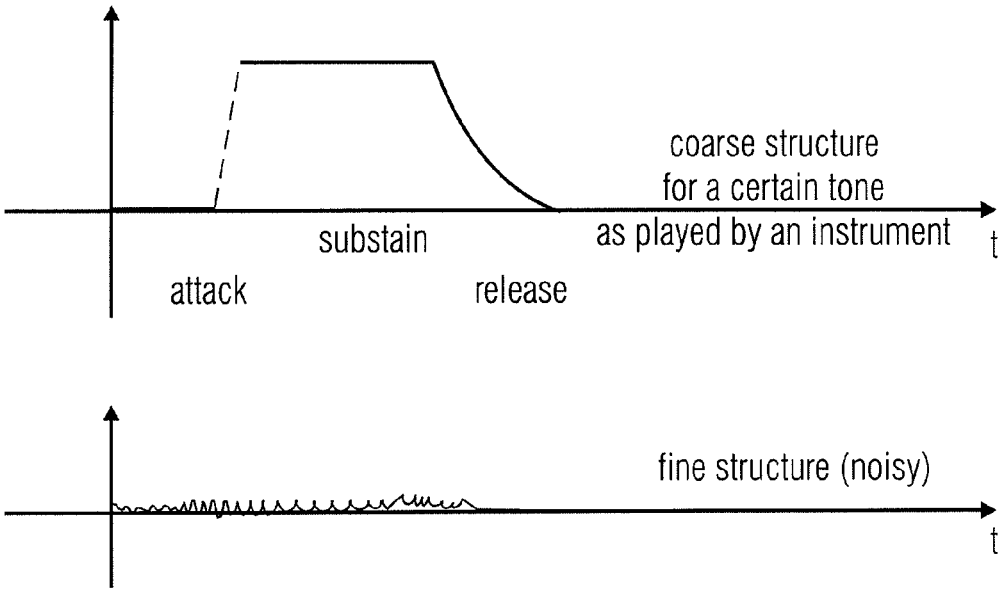
FIG. 3*c* illustrates a schematic representation for explaining a decomposition of AM information into coarse and fine structure information.

FIG. 3*b* illustrates an embodiment of the information modifier 160 in FIG. 3*a*. The AM information is introduced into a decomposition stage for decomposing the AM information into a coarse/fine scale structure. This decomposition is a non linear decomposition such as the decomposition as illustrated in FIG. 3*c*. In order to compress the transmitted data for the AM information, only the coarse structure is, for example, transmitted to a synthesizer. A portion of this synthesizer can be the adder 160*e* and the band pass noise source 160*f*. However, these elements can also be part of the information modifier. In the embodiment, however, a transmission path is between block 160*a* and 160*e*, and on this transmission channel, only a parameterized representation of the coarse structure and, for example, an energy value representing or derived from the fine structure is transmitted via line 161 from an analyzer to a synthesizer. Then, on the synthesizer side, a noise source 160*f* is scaled in order to provide a band pass noise signal for a specific band pass signal, and the noise signal has an energy as indicated via a parameter such as the energy value on line 161. Then, on the decoder/synthesizer side, the noise is temporally shaped by the coarse structure, weighted by its target energy and added to the transmitted coarse structure in order to synthesize a signal that only necessitated a low bit rate for transmission due to the artificial synthesis of the fine structure. Generally, the noise adder 160*f* is for adding a (pseudo-random) noise signal having a certain global energy value and a predetermined temporal energy distribution. It is controlled via transmitted side information or is fixedly set e.g. based on an empirical figure such as fixed values determined for each band. Alternatively it is controlled by a local analysis in the modifier or the synthesizer, in which the available signal is analyzed and noise adder control values are derived. These control values are energy-related values.

The information modifier 160 may, additionally, comprise a constraint polynomial fit functionality 160*b* and/or a transposer 160*d* for the carrier frequencies, which also transposes the FM information via multiplier 160*c*. Alternatively, it might also be useful to only modify the carrier frequencies and to not modify the FM information or the AM information or to only modify the FM information but to not modify the AM information or the carrier frequency information.

Having the modulation components at hand, new and interesting processing methods become feasible. A great advantage of the modulation decomposition presented herein is that the proposed analysis/synthesis method implicitly assures that the result of any modulation processing—independent to a large extent from the exact nature of the processing—will be perceptually smooth (free from clicks, transient repetitions etc.). A few examples of modulation processing are subsumed in FIG. 3*b*.

For sure a prominent application is the 'transposing' of an audio signal while maintaining original playback speed: This is easily achieved by multiplication of all carrier components with a constant factor. Since the temporal structure of the input signal is solely captured by the AM signals it is unaffected by the stretching of the carrier's spectral spacing.

If only a subset of carriers corresponding to certain predefined frequency intervals is mapped to suitable new values, the key mode of a piece of music can be changed from e.g. minor to major or vice versa. To achieve this, the carrier frequencies are quantized to MIDI numbers that are subsequently mapped onto appropriate new MIDI numbers (using a-priori knowledge of mode and key of the music item to be processed). Lastly, the mapped MIDI numbers are converted back in order to obtain the modified carrier frequencies that are used for synthesis. Again, a dedicated MIDI note onset/offset detection is not required since the temporal characteristics are predominantly represented by the unmodified AM and thus preserved.

A more advanced processing is targeting at the modification of a signal's modulation properties: For instance it can be desirable to modify a signal's 'roughness' [14] [15] by modulation filtering. In the AM signal there is coarse structure related to on- and offset of musical events etc. and fine structure related to faster modulation frequencies (~30-300 Hz). Since this fine structure is representing the roughness properties of an audio signal (for carriers up to kHz) [15] [16], auditory roughness can be modified by removing the fine structure and maintaining the coarse structure.

To decompose the envelope into coarse and fine structure, nonlinear methods can be utilized. For example, to capture the coarse AM one can apply a piecewise fit of a (low order) polynomial. The fine structure (residual) is obtained as the difference of original and coarse envelope. The loss of AM fine structure can be perceptually compensated for—if desired—by adding band limited 'grace' noise scaled by the energy of the residual and temporally shaped by the coarse AM envelope.

Note that if any modifications are applied to the AM signal it is advisable to restrict the FM signal to be slowly varying only, since the unprocessed FM may contain sudden peaks due to beating effects inside one band pass region [17] [18]. These peaks appear in the proximity of zero [19] of the AM signal and are perceptually negligible. An example of such a peak in IF can be seen in the signal according to formula (1) in FIG. 9 in form of a phase jump of pi at zero locations of the Hilbert envelope. The undesired peaks can be removed by e.g. constrained polynomial fitting on the FM where the original AM signal acts as weights for the desired goodness of the fit. Thus spikes in the FM can be removed without introducing an undesired bias.

Another application would be to remove FM from the signal. Here one could simply set the FM to zero. Since the carrier signals are centered at local COGs they represent the perceptually correct local mean frequency.

FIG. 3*c* illustrates an example for extracting a coarse structure from a band pass signal. FIG. 3*c* illustrates a typical coarse structure for a tone produced by a certain instrument in the upper plot. At the beginning, the instrument is silent, then at an attack time instant, a sharp rise of the amplitude can be seen, which is then kept constant in a so-called sustain period. Then, the tone is released. This is characterized by a kind of an exponential decay that starts at the end of the sustained period. This is the beginning of the release period, i.e., a release time instant. The sustain period is not necessarily there in instruments. When, for example, a guitar is considered, it becomes clear that the tone is generated by exciting a string and after the attack at the excitation time instant, a release portion, which is quite long, immediately follows which is characterized by the fact that the string oscillation is dampened until the string comes to a stationary state which is, then, the end of the release time. For typical instruments, there exist typical forms or coarse structures for such tones. In order to extract such coarse structures from a band pass signal, it is advantageous to perform a polynomial fit into the band pass signal, where the polynomial fit has a general form similar to the form in the upper plot of FIG. 3*c*, which can be matched by determining the polynomial coefficients. As soon as a best matching polynomial fit is obtained, the signal is determined by the polynomial feed, which is the coarse structure of the band pass signal is subtracted from the actual band pass signal so that the fine structure is obtained which, when the polynomial fit was good enough, is a quite noisy signal which has a certain energy which can be transmitted from the analyzer side to the synthesizer side in addition to the coarse structure information which would be the polynomial coefficients. The decomposition of a band pass signal into its coarse structure and its fine structure is an example for a non-linear decomposition. Other non-linear compositions can be performed as well in order to extract other features from the band pass signal and in order to heavily reduce the data rate for transmitting AM information in a low bit rate application.

Figure 3D:
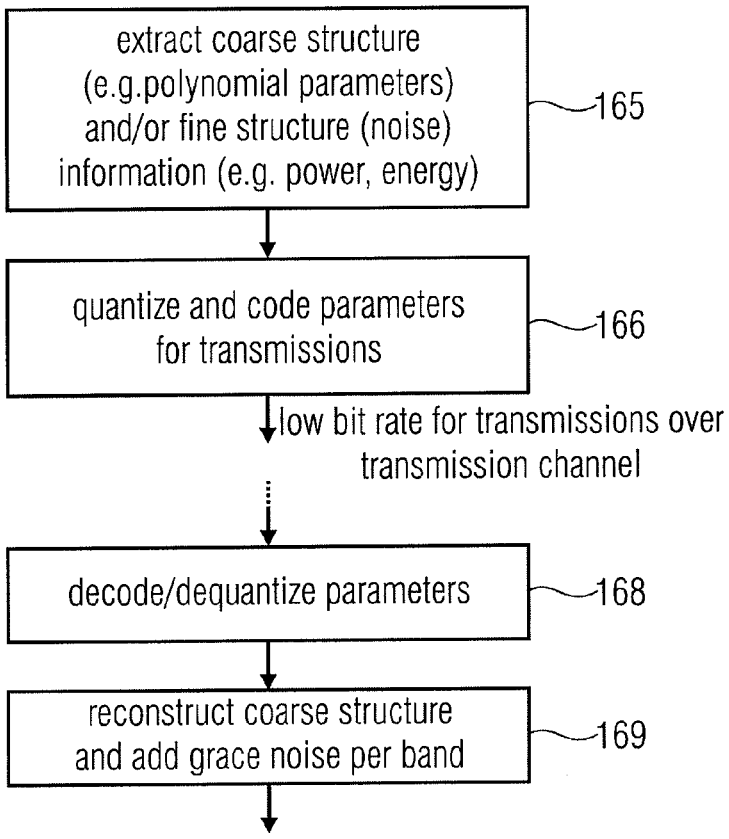
FIG. 3*d* illustrates a compression scenario based on the FIG. 3*c* embodiment.

FIG. 3*d* illustrates the steps in such a procedure. In a step 165, the coarse structure is extracted such as by polynomial fitting and by calculating the polynomial parameters that are, then, the amplitude modulation information to be transmitted from an analyzer to a synthesizer. In order to more efficiently perform this transmission, a further quantization and encoding operation 166 of the parameters for transmission is performed. The quantization can be uniform or non-uniform, and the encoding operation can be any of the well-known entropy encoding operations, such as Huffman coding, with or without tables or arithmetic coding such as a context based arithmetic coding as known from video compression.

Then, a low bit rate AM information or FM/PM information is formed which can be transmitted over a transmission channel in a very efficient manner. On a synthesizer side, a step 168 is performed for decoding and de-quantizing the transmitted parameters. Then, in a step 169, the coarse structure is reconstructed, for example, by actually calculating all values defined by a polynomial that has the transmitted polynomial coefficients. Additionally, it might be useful to add grace noise per band based on transmitted energy parameters and temporally shaped by the coarse AM information or, alternatively, in an ultra bit rate application, by adding (grace) noise having an empirically selected energy.

Alternatively, a signal modification may include, as discussed before, a mapping of the center frequencies to MIDI numbers or, generally, to a musical scale and to then transform the scale in order to, for example, transform a piece of music which is in a major scale to a minor scale or vice versa. In this case, most importantly, the carrier frequencies are modified. The AM information or the PM/FM information is not modified in this case.

Alternatively, other kinds of carrier frequency modifications can be performed such as transposing all carrier frequencies using the same transposition factor which may be an integer number higher than 1 or which may be a fractional number between 1 and 0. In the latter case, the pitch of the tones will be smaller after modification, and in the former case, the pitch of the tones will be higher after modification than before the modification.

FIG. 4*a* illustrates an apparatus for synthesizing a parameterized representation of an audio signal, the parameterized representation comprising band pass information such as carrier frequencies or band pass center frequencies for the band pass filters. Additional components of the parameterized representation is information on an amplitude modulation, information on a frequency modulation or information on a phase modulation of a band pass signal.

In order to synthesize a signal, the apparatus for synthesizing comprises an input interface 200 receiving an unmodified or a modified parameterized representation that includes information for all band pass filters. Exemplarily, FIG. 4*a* illustrates the synthesis modules for a single band pass filter signal. In order to synthesis AM information, an AM synthesizer 201 for synthesizing an AM component based on the AM modulation is provided. Additionally, an FM/PM synthesizer for synthesizing an instantaneous frequency or phase information based on the information on the carrier frequencies and the transmitted PM or FM modulation information is provided as well. Both elements 201, 202 are connected to an oscillator module for generating an output signal, which is AM/FM/PM modulated oscillation signal 204 for each filter bank channel. Furthermore, a combiner 205 is provided for combining signals from the band pass filter channels, such as signals 204 from oscillators for other band pass filter channels and for generating an audio output signal that is based on the signals from the band pass filter channels. Just adding the band pass signals in a sample wise manner in an embodiment, generates the synthesized audio signal 206. However, other combination methods can be used as well.

Figure 4B:
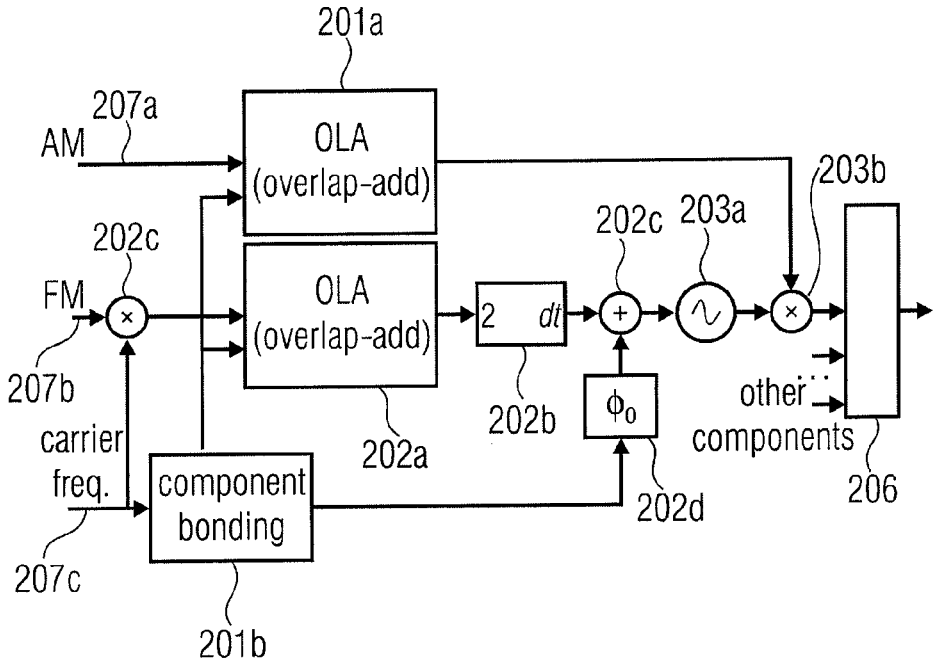
FIG. 4*b* illustrates an embodiment of the FIG. 4*a* concept.

FIG. 4*b* illustrates an embodiment of the FIG. 4*a* synthesizer. An advantageous implementation is based on an overlap-add operation (OLA) in the modulation domain, i.e., in the domain before generating the time domain band pass signal. As illustrated in the middle plot of FIG. 4*c*, the input signal which may be a bit stream, but which may also be a direct connection to an analyzer or modifier as well, is separated into the AM component 207*a*, the FM component 207*b* and the carrier frequency component 207*c*. The AM synthesizer 201 comprises an overlap-adder 201*a* and, additionally, a component bonding controller 201*b* which, not only comprises block 201*a* but also block 202*a*, which is an overlap adder within the FM synthesizer 202. The FM synthesizer 202 additionally comprises a frequency overlap-adder 202*a*, a phase integrator 202*b*, a phase combiner 202*c* which, again, may be implemented as a regular adder and a phase shifter 202*d* which is controllable by the component binding controller 201*b* in order to regenerate a constant phase from block to block so that the phase of a signal from a preceding block is continuous with the phase of an actual block. Therefore, one can say that the phase addition in elements 202*d*, 202*c* corresponds to a regeneration of a constant that was lost during the differentiation in block 110*g* in FIG. 1*b* on the analyzer side. From an information-loss perspective in the perceptual domain, it is to be noted that this is the only information loss, i.e., the loss of a constant portion by the differentiation device 110*g* in FIG. 1*b*. This loss is recreated by adding a constant phase determined by the component bonding device 201*b* in FIG. 4*b*.

The signal is synthesized on an additive basis of all components. For one component the processing chain is shown in FIG. 4*b*. Like the analysis, the synthesis is performed on a block-by-block basis. Since only the centered N/2 portion of each analysis block is used for synthesis, an overlap factor of ½ results. A component bonding mechanism is utilized to blend AM and FM and align absolute phase for components in spectral vicinity of their predecessors in a previous block. Spectral vicinity is also calculated on a bark scale basis to again reflect the sensitivity of the human ear with respect to pitch perception.

In detail firstly the FM signal is added to the carrier frequency and the result is passed on to the overlap-add (OLA) stage. Then it is integrated to obtain the phase of the component to be synthesized. A sinusoidal oscillator is fed by the resulting phase signal. The AM signal is processed likewise by another OLA stage. Finally the oscillator's output is modulated in its amplitude by the resulting AM signal to obtain the components' additive contribution to the output signal.

FIG. 4*c*, lower block shows an implementation of the overlap add operation in the case of 50% overlap. In this implementation, the first part of the actually utilized information from the current block is added to the corresponding part that is the second part of a preceding block. Furthermore, FIG. 4*c*, lower block, illustrates a cross-fading operation where the portion of the block that is faded out receives decreasing weights from 1 to 0 and, at the same time, the block to be faded in receives increasing weights from 0 to 1. These weights can already be applied on the analyzer side and, then, only an adder operation on the decoder side is needed. However, these weights are not applied on the encoder side but are applied on the decoder side in a predefined way. As discussed before, only the centered N/2 portion of each analysis block is used for synthesis so that an overlap factor of ½ results as illustrated in FIG. 4*c*. However, one could also use the complete portion of each analysis block for overlap/add so that a 4-fold overlap as illustrated in the upper portion of FIG. 4*c* is illustrated. The described embodiment, in which the center part is used, is advantageous, since the outer quarters include the roll-off of the analysis window and the center quarters only have the flat-top portion.

All other overlap ratios can be implemented as the case may be.

Figure 4D:
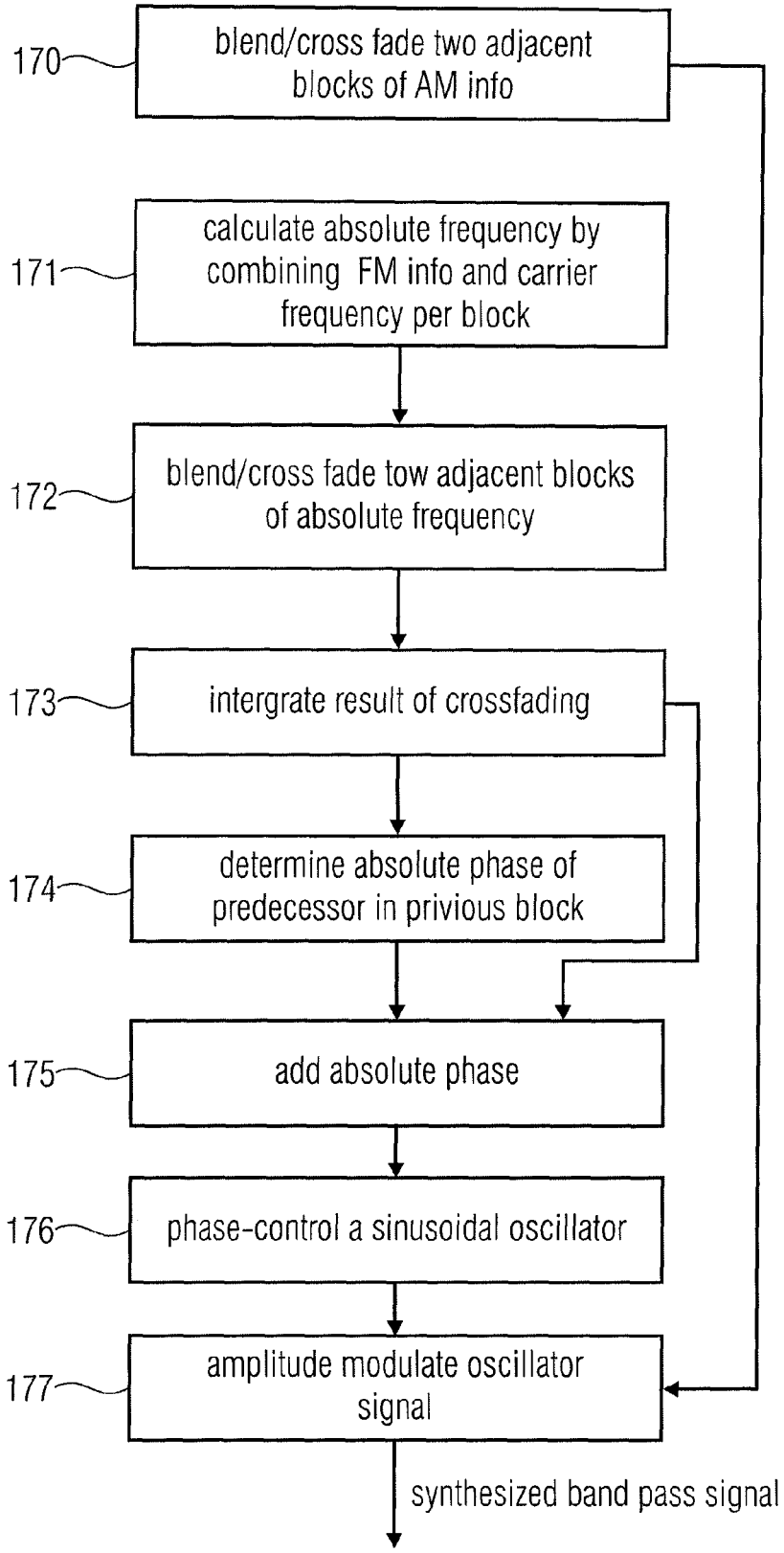
FIG. 4*d* illustrates a flow chart of an embodiment for synthesizing an audio signal using a parameterized representation.
Figure 5:
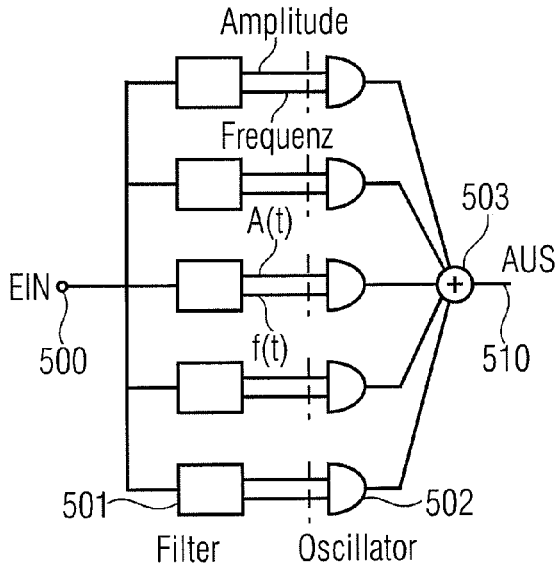
FIG 5 (Prior Art)
FIG. 5 illustrates a standard analysis/synthesis vocoder structure.
Figure 6:
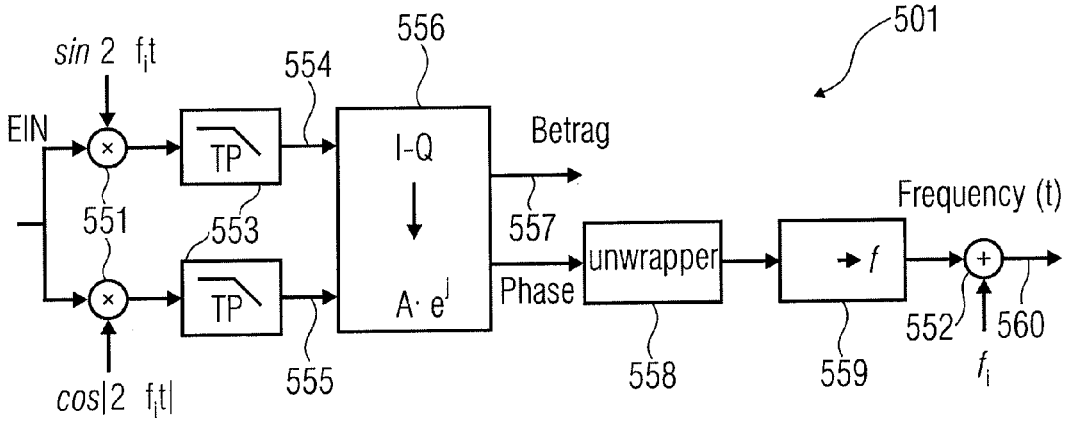
FIG 6 (Prior Art)
FIG. 6 illustrates the standard filter implementation of FIG. 5.

FIG. 4*d* illustrates a sequence of steps to be performed within the FIGS. 4*a*/4*b* embodiment. In a step 170, two adjacent blocks of AM information are blended/cross faded. This cross-fading operation is performed in the modulation parameter domain rather than in the domain of the readily synthesized, modulated band-pass time signal. Thus, beating artifacts between the two signals to be blended are avoided compared to the case, in which the cross fade would be performed in the time domain and not in the modulation parameter domain. In step 171, an absolute frequency for a certain instant is calculated by combining the block-wise carrier frequency for a band pass signal with the fine resolution FM information using adder 202*c*. Then, in step 171, two adjacent blocks of absolute frequency information are blended/cross faded in order to obtain a blended instantaneous frequency at the output of block 202*a*. In step 173, the result of the OLA operation 202*a* is integrated as illustrated in block 202*b* in FIG. 4*b*. Furthermore, the component bonding operation 201*b* determines the absolute phase of a corresponding predecessor frequency in a previous block as illustrated at 174. Based on the determined phase, the phase shifter 202*d* of FIG. 4*b* adjusts the absolute phase of the signal by addition of a suitable $\phi_0$ in block 202*c* which is also illustrated by step 175 in FIG. 4*d*. Now, the phase is ready for phase-controlling a sinusoidal oscillator as indicated in step 176. Finally, the oscillator output signal is amplitude-modulated in step 177 using the cross faded amplitude information of block 170. The amplitude modulator such as the multiplier 203*b* finally outputs a synthesized band pass signal for a certain band pass channel which, due to the inventive procedure has a frequency band width which varies from low to high with increasing band pass center frequency.

Figure 7A:
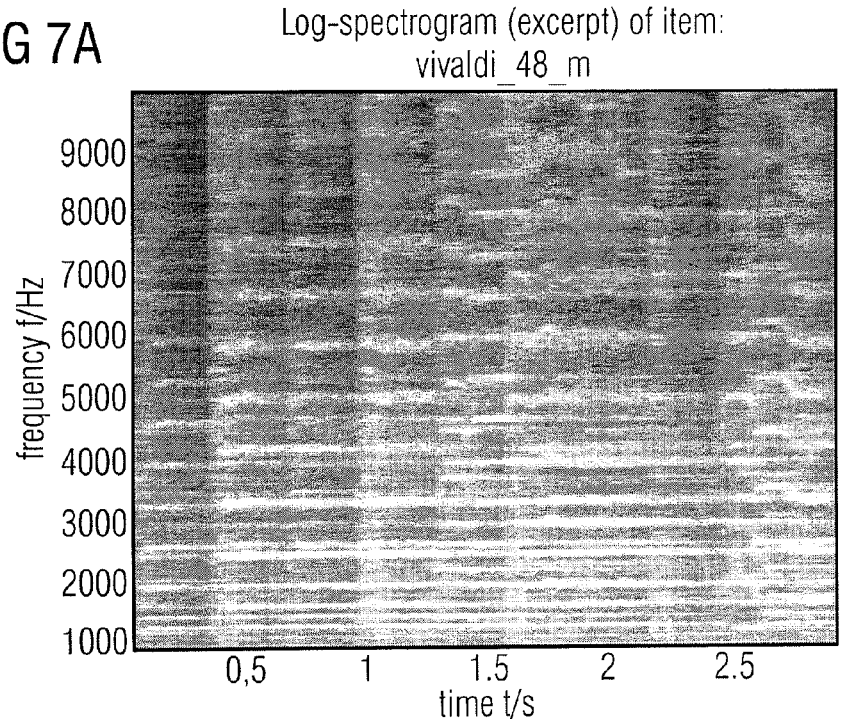
FIG. 7*a* illustrates a spectrogram of an original music item.

In the following, some spectrograms are presented that demonstrate the properties of the proposed modulation processing schemes. FIG. 7*a* shows the original log spectrogram of an excerpt of an orchestral classical music item (Vivaldi).

Figure 7B:
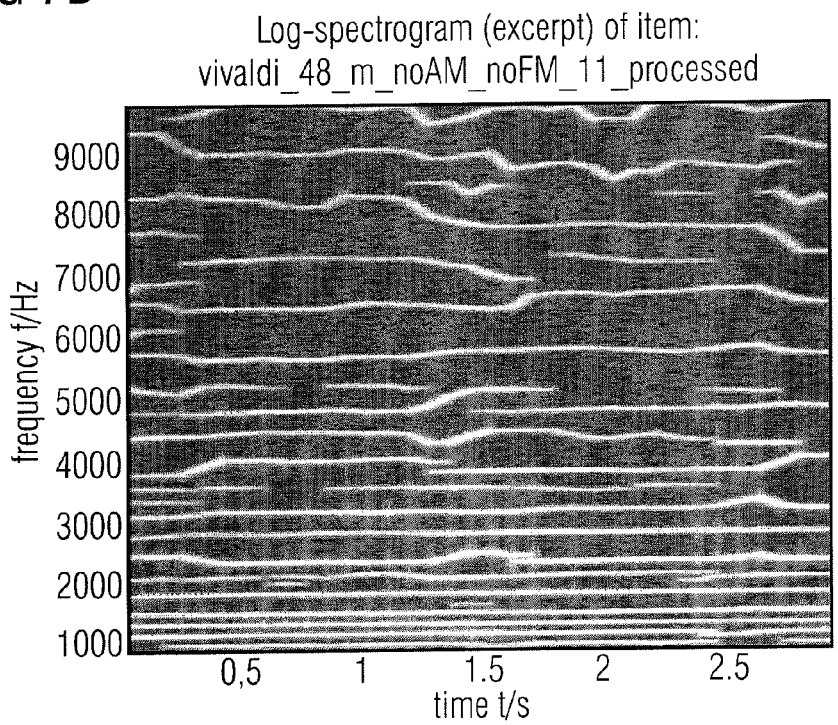
FIG. 7*b* illustrates a spectrogram of the synthesized carriers only.
Figure 7C:
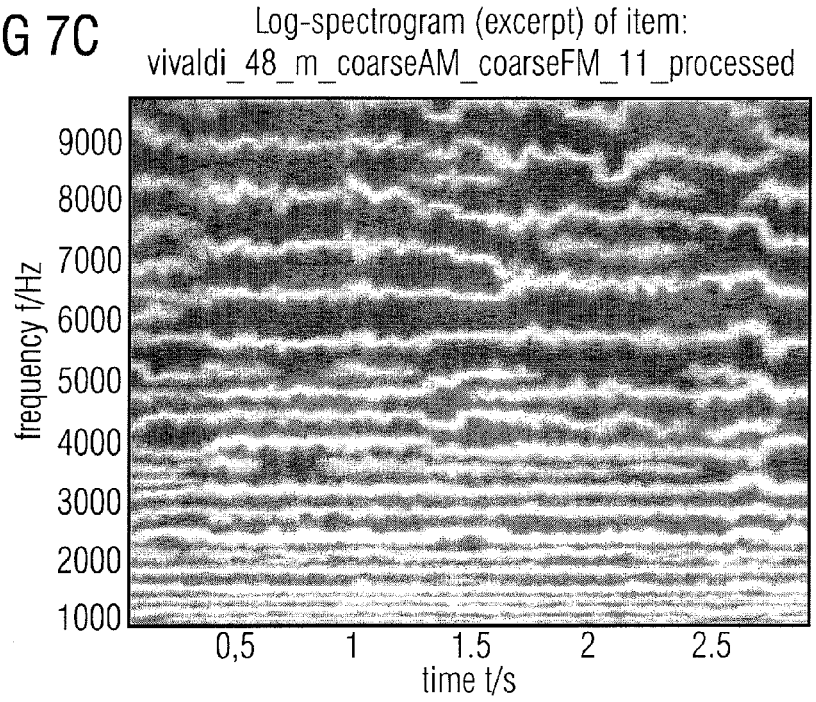
FIG. 7*c* illustrates a spectrogram of the carriers refined by coarse AM and FM.
Figure 7D:
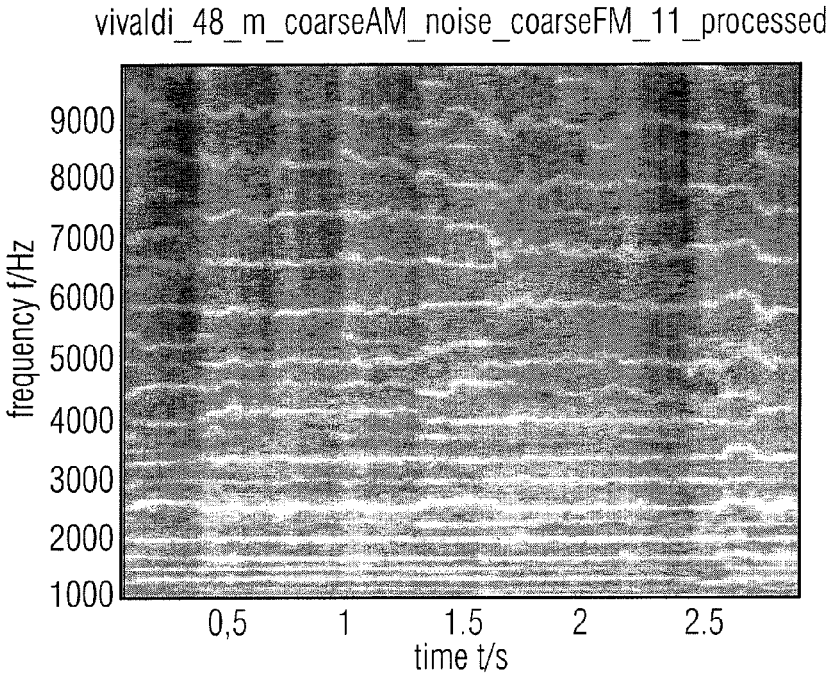
FIG. 7*d* illustrates a spectrogram of the carriers refined by coarse AM and FM, and added "grace noise"
Figure 7E:
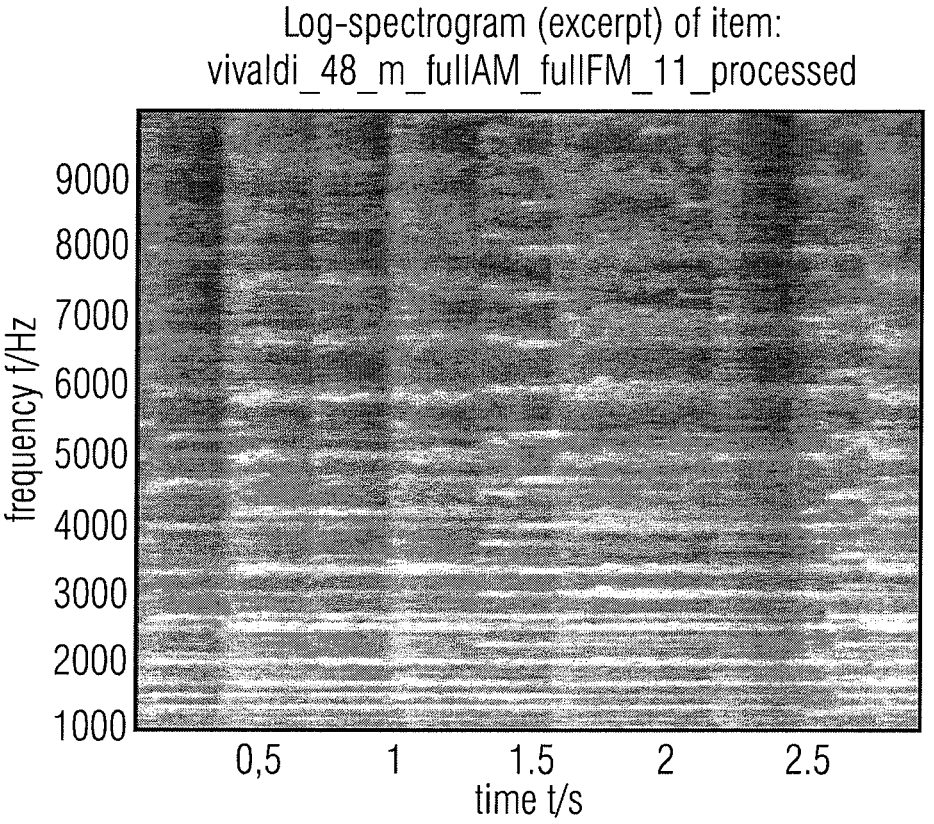
FIG. 7*e* illustrates a spectrogram of the carriers and unprocessed AM and FM after synthesis.

FIG. 7*b* to FIG. 7*e* show the corresponding spectrograms after various methods of modulation processing in order of increasingly restored modulation detail. FIG. 7*b* illustrates the signal reconstruction solely from the carriers. The white regions correspond to high spectral energy and coincide with the local energy concentration in the spectrogram of the original signal in FIG. 7*a*. FIG. 7*c* depicts the same carriers but refined by non-linearly smoothed AM and FM. The addition of detail is clearly visible. In FIG. 7*d* additionally the loss of AM detail is compensated for by addition of envelope shaped 'grace' noise which again adds more detail to the signal. Finally the spectrogram of the synthesized signal from the unmodified modulation components is shown in FIG. 7*e*. Comparing the spectrogram in FIG. 7*e* to the spectrogram of the original signal in FIG. 7*a* illustrates the very good reproduction of the full details.

To evaluate the performance of the proposed method, a subjective listening test was conducted. The MUSHRA [21] type listening test was conducted using STAX high quality electrostatic headphones. A total number of 6 listeners participated in the test. All subjects can be considered as experienced listeners.

Figures 9B, 9C:
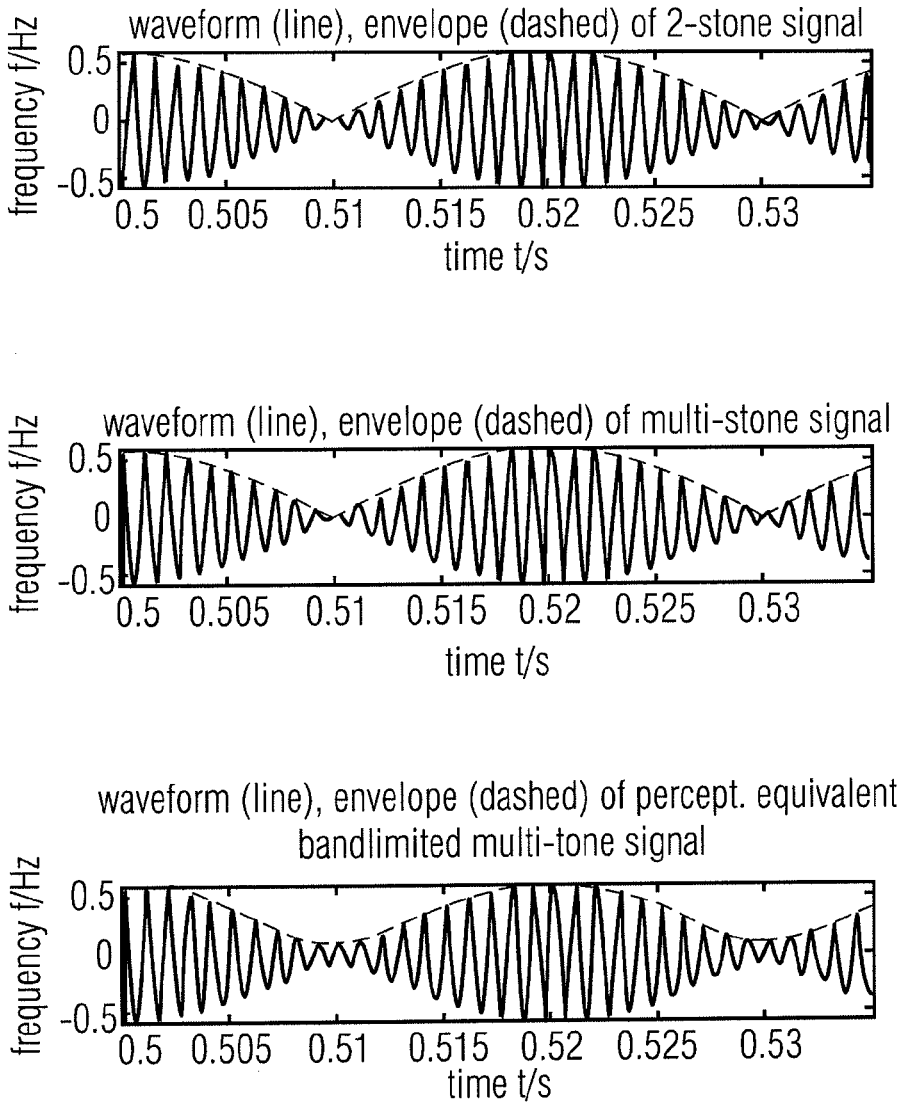
FIG. 9*b* illustrates a waveform and envelope of a two-tone signal, a multi-tone signal and an appropriately band-limited multi-tone signal.
FIG. 9*c* illustrates equations for generating two perceptually—in a band pass sense—equivalent signals.

The test set consisted of the items listed in FIG. 8 and the configurations under test are subsumed in FIG. 9.

The chart plot in FIG. 8 displays the outcome. Shown are the mean results with 95% confidence intervals for each item. The plots show the results after statistical analysis of the test results for all listeners. The X-axis shows the processing type and the Y-axis represents the score according to the 100-point MUSHRA scale ranging from 0 (bad) to 100 (transparent).

From the results it can be seen that the two versions having full AM and full or coarse FM detail score best at approx. 80 points in the mean, but are still distinguishable from the original. Since the confidence intervals of both versions largely overlap, one can conclude that the loss of FM fine detail is indeed perceptually negligible. The version with coarse AM and FM and added 'grace' noise scores considerably lower but in the mean still at 60 points: this reflects the graceful degradation property of the proposed method with increasing omission of fine AM detail information.

Most degradation is perceived for items having strong transient content like glockenspiel and harpsichord. This is due to the loss of the original phase relations between the different components across the spectrum. However, this problem might be overcome in future versions of the proposed synthesis method by adjusting the carrier phase at temporal centres of gravity of the AM envelope jointly for all components.

For the classical music items in the test set the observed degradation is statistically insignificant The analysis/synthesis method presented could be of use in different application scenarios: For audio coding it could serve as a building block of an enhanced perceptually correct fine grain scalable audio coder the basic principle of which has been published in [1]. With decreasing bit rate less detail might be conveyed to the receiver side by e.g. replacing the full AM envelope by a coarse one and added 'grace' noise.

Furthermore new concepts of audio bandwidth extension [20] are conceivable which e.g. use shifted and altered baseband components to form the high bands. Improved experiments on human auditory properties become feasible e.g. improved creation of chimeric sounds in order to further evaluate the human perception of modulation structure [11].

Last not least new and exciting artistic audio effects for music production are within reach: either scale and key mode of a music item can be altered by suitable processing of the carrier signals or the psycho acoustical property of roughness sensation can be accessed by manipulation on the AM components.

A proposal of a system for decomposing an arbitrary audio signal into perceptually meaningful carrier and AM/FM components has been presented, which allows for fine grain scalability of modulation detail modification. An appropriate re-synthesis method has been given. Some examples of modulation processing principles have been outlined and the resulting spectrograms of an example audio file have been presented. A listening test has been conducted to verify the perceptual quality of different types of modulation processing and subsequent re-synthesis. Future application scenarios for this promising new analysis/synthesis method have been identified. The results demonstrate that the proposed method provides appropriate means to bridge the gap between parametric and waveform audio processing and moreover renders new fascinating audio effects possible.

The described embodiments are merely illustrative for the principles of the present invention. It is understood that modifications and variations of the arrangements and the details described herein will be apparent to others skilled in the art. It is the intent, therefore, to be limited only by the scope of the impending patent claims and not by the specific details presented by way of description and explanation of the embodiments herein.

Depending on certain implementation requirements of the inventive methods, the inventive methods can be implemented in hardware or in software. The implementation can be performed using a digital storage medium, in particular, a disc, a DVD or a CD having electronically-readable control signals stored thereon, which co-operate with programmable computer systems such that the inventive methods are performed. Generally, the present invention is therefore a computer program product with a program code stored on a machine-readable carrier, the program code being operated for performing the inventive methods when the computer program product runs on a computer. In other words, the inventive methods are, therefore, a computer program having a program code for performing at least one of the inventive methods when the computer program runs on a computer.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

REFERENCES

[1] M. Vinton and L. Atlas, "A Scalable And Progressive Audio Codec," in *Proc. of ICASSP* 2001, pp. 3277-3280, 2001

[2] H. Dudley, "The vocoder," in *Bell Labs Record*, vol. 17, pp. 122-126, 1939

[3] J. L. Flanagan and R. M. Golden, "Phase Vocoder," in *Bell System Technical Journal*, vol. 45, pp. 1493-1509, 1966

[4] J. L. Flanagan, "Parametric coding of speech spectra," *J. Acoust. Soc. Am.*, vol. 68 (2), pp. 412-419, 1980

[5] U. Zoelzer, *DAFX: Digital Audio Effects*, Wiley & Sons, pp. 201-298, 2002

[6] H. Kawahara, "Speech representation and transformation using adaptive interpolation of weighted spectrum: vocoder revisited," in *Proc. of ICASSP* 1997, vol. 2, pp. 1303-1306, 1997

[7]A. Rao and R. Kumaresan, "On decomposing speech into modulated components," in *IEEE Trans. on Speech and Audio Processing*, vol. 8, pp. 240-254, 2000

[8] M. Christensen et al., "Multiband amplitude modulated sinusoidal audio modelling," in *IEEE Proc. of ICASSP* 2004, vol. 4, pp. 169-172, 2004

[9] K. Nie and F. Zeng, "A perception-based processing strategy for cochlear implants and speech coding," in *Proc. of the 26th IEEE-EMBS*, vol. 6, pp. 4205-4208, 2004

[10] J. Thiemann and P. Kabal, "Reconstructing Audio Signals from Modified Non-Coherent Hilbert Envelopes," in *Proc. Interspeech* (*Antwerp, Belgium*), pp. 534-537, 2007

[11] Z. M. Smith and B. Delgutte and A. J. Oxenham, "Chimaeric sounds reveal dichotomies in auditory perception," in *Nature*, vol. 416, pp. 87-90, 2002

[12] J. N. Anantharaman and A. K. Krishnamurthy, L. L Feth, "Intensity weighted average of instantaneous frequency as a model for frequency discrimination," in *J. Acoust. Soc. Am.*, vol. 94 (2), pp. 723-729, 1993

[13] 0. Ghitza, "On the upper cutoff frequency of the auditory critical-band envelope detectors in the context of speech perception," in *J. Acoust. Soc. Amer.*, vol. 110(3), pp. 1628-1640, 2001

[14] E. Zwicker and H. Fastl, *Psychoacoustics—Facts and Models*, Springer, 1999

[15] E. Terhardt, "On the perception of periodic sound fluctuations (roughness)," in *Acustica*, vol. 30, pp. 201-213, 1974

[16] P. Daniel and R. Weber, "Psychoacoustical Roughness: Implementation of an Optimized Model," in *Acustica*, vol. 83, pp. 113-123, 1997

[17] P. Loughlin and B. Tacer, "Comments on the interpretation of instantaneous frequency," in *IEEE Signal Processing Lett.*, vol. 4, pp. 123-125, 1997.

[18] D. Wei and A. Bovik, "On the instantaneous frequencies of multicomponent AM-FM signals," in *IEEE Signal Processing Lett.*, vol. 5, pp. 84-86, 1998.

[19] Q. Li and L. Atlas, "Over-modulated AM-FM decomposition," in*Proceedings of the SPIE*, vol. 5559, pp. 172-183, 2004

[20] M. Dietz, L. Liljeryd, K. Kjörling and O. Kunz, "Spectral Band Replication, a novel approach in audio coding," in *112th AES Convention*, Munich, May 2002.

[21] ITU-R Recommendation BS.1534-1, "Method for the subjective assessment of intermediate sound quality (MUSHRA)," *International Telecommunications Union*, Geneva, Switzerland, 2001.

[22] "Sinusoidal modeling parameter estimation via a dynamic channel vocoder model" A. S. Master, 2002 IEEE International Conference on Acoustics, Speech and Signal Processing.

The invention claimed is:

1. Apparatus for converting an audio signal into a parameterized representation, comprising:

a signal analyzer for analyzing a portion of the audio signal to acquire an analysis result, wherein the signal analyzer is operative to calculate a center of gravity position function for a spectral representation of the portion of the audio signal, wherein predetermined events in the center of gravity position function indicate candidate values for center frequencies of the plurality of band pass filters;

a band pass estimator for estimating information of a plurality of band pass filters based on the analysis result, wherein the information on the plurality of band pass filters comprises information on a filter shape for the portion of the audio signal, wherein the band width of a band pass filter is different over an audio spectrum and depends on the center frequency of the band pass filter, wherein the band pass estimator is operative to determine the center frequencies based on the candidate values;

a modulation estimator for estimating an amplitude modulation or a frequency modulation or a phase modulation for each band of the plurality of band pass filters for the portion of the audio signal using the information on the plurality of band pass filters; and an output interface for transmitting, storing or modifying information on the amplitude modulation, information on the frequency modulation or phase modulation or the information on the plurality of band pass filters for the portion of the audio signal.

2. Apparatus in accordance with claim 1, in which the signal analyzer is operative to calculate a center of gravity position value for a band.

3. Apparatus in accordance with claim 1, in which the signal analyzer is operative to add negative power values of a first half of a band and adding positive power values of a second half of a band to acquire a center of gravity position candidate value, wherein the center of gravity position candidate values are smoothed over time to acquire smoothed center of gravity position values, and wherein the band pass filter estimator is operative to determine the frequencies of zero crossings of the smoothed center of gravity position values over time.

4. Apparatus in accordance with claim 1, in which the band pass estimator is operative to determine the information of the center frequency or the band width of the band pass filters so that a spectrum from a lower start value to a higher end value is covered without a spectral hole, where the lower start value and the higher end value comprises at least five band pass filter bandwidths.

5. Apparatus in accordance with claim 1, in which the band pass estimator is operative to determine the information such that the frequency of zero crossings are modified in such a way that an approximately equal band pass center frequency spacing with respect to a perceptual scale results, where a distance between the band pass center frequencies and frequencies of zero crossings in a center of gravity position function is minimized.

6. Apparatus in accordance with claim 1, in which the modulation estimator is operative to form an analytical signal of a band pass signal for the band pass and to calculate a magnitude of the analytical signal to acquire information on the amplitude modulation of the audio signal in the band of the band pass filter.

7. Method of converting an audio signal into a parameterized representation, comprising:

analyzing a portion of the audio signal to acquire an analysis result, wherein a center of gravity position function for a spectral representation of the portion of the audio signal is calculated, wherein predetermined events in the center of gravity position function indicate candidate values for center frequencies of the plurality of band pass filters;

estimating information of a plurality of band pass filters based on the analysis result, wherein the information on the plurality of band pass filters comprises information on a filter shape for the portion of the audio signal, wherein the band width of a band pass filter is different over an audio spectrum and depends on the center frequency of the band pass filter, wherein the step of estimating determines the center frequencies based on the candidate values;

estimating an amplitude modulation or a frequency modulation or a phase modulation for each band of the plurality of band pass filters for the portion of the audio signal using the information on the plurality of band pass filters; and transmitting, storing or modifying information on the amplitude modulation, information on the frequency modulation or phase modulation or the information on the plurality of band pass filters for the portion of the audio signal.

8. Apparatus for modifying a parameterized representation comprising, for a time portion of an audio signal, band pass filter information for a plurality of band pass filters, the band pass filter information indicating time-varying band pass filter center frequencies of band pass filters comprising band widths, which depend on a band pass filter center frequency of the corresponding band pass filters, and amplitude modulation or phase modulation or frequency modulation information for each band pass filter for the time portion of the audio signal, the modulation information being related to the center frequencies of the band pass filters, the apparatus comprising:

a modifier for modifying the time varying center frequencies and for generating a modified parameterized representation, in which the band widths of the band pass filters depend on the band pass filter center frequencies of the corresponding band pass filters.

9. Apparatus in accordance with claim 8, in which the modifier is operative to modify all center frequencies by multiplication with a constant factor or by only changing selected center frequencies in order to change the key mode of a piece of music from e.g. major to minor or vice versa.

10. Method of modifying a parameterized representation comprising, for a time portion of an audio signal, band pass filter information for a plurality of band pass filters, the band pass filter information indicating time-varying band pass filter center frequencies of band pass filters comprising band widths, which depend on a band pass filter center frequency of the corresponding band pass filters, and comprising amplitude modulation or phase modulation or frequency modulation information for each band pass filter for the time portion of the audio signal, the modulation information being related to the center frequencies of the band pass filters, the method comprising:

modifying the time varying center frequencies and generating a modified parameterized representation, in which the band widths of the band pass filters depend on the band pass filter center frequencies of the corresponding band pass filters.

11. Apparatus for synthesizing a parameterized representation of an audio signal comprising a time portion of an audio signal, band pass filter information for a plurality of band pass filters, the band pass filter information indicating time-varying band pass filter center frequencies of band pass filters comprising varying band widths, which depend on a band pass filter center frequency of the corresponding band pass filter, and comprising amplitude modulation or phase modulation or frequency modulation information for each band pass filter for the time portion of the audio signal, comprising:

an amplitude modulation synthesizer for synthesizing an amplitude modulation component based on the amplitude modulation information;

a frequency modulation or phase modulation synthesizer for synthesizing instantaneous frequency of phase information based on the information on a carrier frequency and a frequency modulation information for a respective band width, wherein distances in frequency between adjacent carrier frequencies are different over a frequency spectrum, an oscillator for generating an output signal representing an instantaneously amplitude modulated, frequency modulated or phase modulated oscillation signal for each band pass filter channel; and a combiner for combining signals from the band pass filter channels and for generating an audio output signal based on the signals from the band pass filter channels, wherein the amplitude modulation synthesizer comprises an overlap adder for overlapping and weighted adding subsequent blocks of amplitude modulation information to acquire the amplitude modulation component; or wherein the frequency modulation or phase modulation synthesizer comprises and overlap-adder for weighted adding two subsequent blocks of frequency modulation or phase modulation information or a combined representation of the frequency modulation information and the carrier frequency for a band pass signal to acquire the synthesized frequency information.

12. Apparatus in accordance with claim 11, in which the frequency modulation or phase modulation synthesizer comprises an integrator for integrating the synthesized frequency information and for adding, to the synthesized frequency information, a phase term derived from a phase of a component in spectral vicinity from a previous block of an output signal of the oscillator.

13. Apparatus in accordance with claim 12, in which the oscillator is a sinusoidal oscillator fed by a phase signal acquired by the adding operation.

14. Apparatus in accordance with claim 13, in which the oscillator comprises a modulator for modulating an output signal of the sinusoidal oscillator using the amplitude modulation component for the band.

15. Method of synthesizing a parameterized representation of an audio signal comprising a time portion of an audio signal, band pass filter information for a plurality of band pass filters, the band pass filter information indicating time-varying band pass filter center frequencies of band pass filters comprising varying band widths, which depend on a band pass filter center frequency of the corresponding band pass filter, and comprising amplitude modulation or phase modulation or frequency modulation information for each band pass filter for the time portion of the audio signal, comprising:

synthesizing an amplitude modulation component based on the amplitude modulation information;

synthesizing instantaneous frequency or phase information based on the information on a carrier frequency and a frequency modulation information for a respective band width, wherein distances in frequency between adjacent carrier frequencies are different over a frequency spectrum, generating an output signal representing an instantaneously amplitude modulated, frequency modulated or phase modulated oscillation signal for each band pass filter channel; and combining signals from the band pass filter channels and generating an audio output signal based on the signals from the band pass filter channels, wherein the step of synthesizing an amplitude modulation component comprises a step of overlapping and weighted adding subsequent blocks of amplitude modulation information to acquire the amplitude modulation component; or wherein the step of synthesizing instantaneous frequency or phase information comprises a step of weighted adding two subsequent blocks of frequency modulation or phase modulation information or a combined representation of the frequency modulation information and the carrier frequency for a band pass signal to acquire the synthesized frequency information.

16. A non-transitory storage medium having stored thereon a computer program for performing, when running on a computer, a method in accordance with claim 7, 10 or 15.

17. Apparatus for converting an audio signal into a parameterized representation, comprising:

a signal analyzer for analyzing a portion of the audio signal to acquire an analysis result;

a band pass estimator for estimating information of a plurality of band pass filters based on the analysis result, wherein the information on the plurality of band pass filters comprises information on a filter shape for the portion of the audio signal, wherein the band width of a band pass filter is different over an audio spectrum and depends on the center frequency of the band pass filter;

a modulation estimator for estimating an amplitude modulation or a frequency modulation or a phase modulation for each band of the plurality of band pass filters for the portion of the audio signal using the information on the plurality of band pass filters, wherein the modulation estimator is operative to downmix a band pass signal with a carrier comprising the center frequency of the respective band pass to acquire information on the frequency modulation or phase modulation in the band of the band pass filter; and an output interface for transmitting, storing or modifying information on the amplitude modulation, information on the frequency modulation or phase modulation or the information on the plurality of band pass filters for the portion of the audio signal.

18. Method of converting an audio signal into a parameterized representation, comprising:

analyzing a portion of the audio signal to acquire an analysis result;

estimating information of a plurality of band pass filters based on the analysis result, wherein the information on the plurality of band pass filters comprises information on a filter shape for the portion of the audio signal, wherein the band width of a band pass filter is different over an audio spectrum and depends on the center frequency of the band pass filter;

estimating an amplitude modulation or a frequency modulation or a phase modulation for each band of the plurality of band pass filters for the portion of the audio signal using the information on the plurality of band pass filters, wherein a band pass signal is downmixed with a carrier comprising the center frequency of the respective band pass to acquire information on the frequency modulation or phase modulation in the band of the band pass filter; and transmitting, storing or modifying information on the amplitude modulation, information on the frequency modulation or phase modulation or the information on the plurality of band pass filters for the portion of the audio signal.

19. Apparatus for modifying a parameterized representation comprising, for a time portion of an audio signal, band pass filter information for a plurality of band pass filters, the band pass filter information indicating time-varying band pass filter center frequencies of band pass filters comprising band widths, which depend on a band pass filter center frequency of the corresponding band pass filters, and comprising amplitude modulation or phase modulation or frequency modulation information for each band pass filter for the time portion of the audio signal, the modulation information being related to the center frequencies of the band pass filters, the apparatus comprising:

a modifier for modifying the time varying center frequencies or for modifying the amplitude modulation or phase modulation or frequency modulation information and for generating a modified parameterized representation, in which the band widths of the band pass filters depend on the band pass filter center frequencies of the corresponding band pass filters, wherein the modifier is operative to modify the amplitude modulation information or the phase modulation information or the frequency modulation information by a non-linear decomposition into a coarse structure and a fine structure and by only modifying either the coarse structure or the fine structure.

20. Method of modifying a parameterized representation comprising, for a time portion of an audio signal, band pass filter information for a plurality of band pass filters, the band pass filter information indicating time-varying band pass filter center frequencies of band pass filters comprising band widths, which depend on a band pass filter center frequency of the corresponding band pass filters, and comprising amplitude modulation or phase modulation or frequency modulation information for each band pass filter for the time portion of the audio signal, the modulation information being related to the center frequencies of the band pass filters, the apparatus comprising:

modifying the time varying center frequencies or modifying the amplitude modulation or phase modulation or frequency modulation information and generating a modified parameterized representation, in which the band widths of the band pass filters depend on the band pass filter center frequencies of the corresponding band pass filters, wherein the modifying modifies the amplitude modulation information or the phase modulation information or the frequency modulation information by a non-linear decomposition into a coarse structure and a fine structure and by only modifying either the coarse structure or the fine structure.

21. Apparatus for synthesizing a parameterized representation of an audio signal comprising a time portion of an audio signal, band pass filter information for a plurality of band pass filters, the band pass filter information indicating time-varying band pass filter center frequencies of band pass filters comprising varying band widths, which depend on a band pass filter center frequency of the corresponding band pass filter, and comprising amplitude modulation or phase modulation or frequency modulation information for each band pass filter for the time portion of the audio signal, comprising:

an amplitude modulation synthesizer for synthesizing an amplitude modulation component based on the amplitude modulation information, wherein the amplitude modulation synthesizer comprises a noise adder for adding noise, the noise adder being controlled via transmitted side information, being fixedly set or being controlled by a local analysis;

a frequency modulation or phase modulation synthesizer for synthesizing instantaneous frequency of phase information based on the information on a carrier frequency and a frequency modulation information for a respective band width, wherein distances in frequency between adjacent carrier frequencies are different over a frequency spectrum, an oscillator for generating an output signal representing an instantaneously amplitude modulated, frequency modulated or phase modulated oscillation signal for each band pass filter channel; and a combiner for combining signals from the band pass filter channels and for generating an audio output signal based on the signals from the band pass filter channels.

22. Method of synthesizing a parameterized representation of an audio signal comprising a time portion of an audio signal, band pass filter information for a plurality of band pass filters, the band pass filter information indicating time-varying band pass filter center frequencies of band pass filters comprising varying band widths, which depend on a band pass filter center frequency of the corresponding band pass filter, and comprising amplitude modulation or phase modulation or frequency modulation information for each band pass filter for the time portion of the audio signal, comprising:

synthesizing an amplitude modulation component based on the amplitude modulation information, the step of synthesizing comprising a step of adding noise controlled via transmitted side information, the side information being fixedly set or being controlled by a local analysis;

synthesizing instantaneous frequency or phase information based on the information on a carrier frequency and a frequency modulation information for a respective band width, wherein distances in frequency between adjacent carrier frequencies are different over a frequency spectrum, generating an output signal representing an instantaneously amplitude modulated, frequency modulated or phase modulated oscillation signal for each band pass filter channel; and combining signals from the band pass filter channels and for generating an audio output signal based on the signals from the band pass filter channels.

23. A non-transitory storage medium having stored thereon a computer program for performing, when running on a computer, a method in accordance with claim 18, 20 or 22.

* * * * *

UNITED STATES PATENT AND TRADEMARK OFFICE

CERTIFICATE OF CORRECTION

PATENT NO. : 8,793,123 B2
APPLICATION NO. : 12/922823
DATED : July 29, 2014
INVENTOR(S) : Sascha Disch It is certified that error appears in the above-identified patent and that said Letters Patent is hereby corrected as shown below:

Title Page, item (54) Title:

APPARATUS AND METHOD FOR CONVERTING AN AUDIO SIGNAL INTO A PARAMETERIZED REPRESENTATION USING BAND PASS FILTERS, APPARATUS AND METHOD FOR MODIFYING A PARAMETERIZED REPRESENTATION USING BAND PASS FILTER, APPARATUS AND METHOD FOR SYNTHESIZING A PARAMETERIZED OF AN AUDIO SIGNAL USING BAND PASS FILTERS should read:

APPARATUS AND METHOD FOR CONVERTING AN AUDIO SIGNAL INTO A PARAMETERIZED REPRESENTATION USING BAND PASS FILTERS, APPARATUS AND METHOD FOR MODIFYING A PARAMETERIZED REPRESENTATION USING BAND PASS FILTERS, APPARATUS AND METHOD FOR SYNTHESIZING A PARAMETERIZED REPRESENTATION OF AN AUDIO SIGNAL USING BAND PASS FILTERS

Title Page, item (73) Assignee:

Fraunhofer-Gesellschaft zur Foerderung der Angewandten Forschung E.V.

should be:

Fraunhofer-Gesellschaft zur Foerderung der angewandten Forschung e.V.

Signed and Sealed this
Second Day of February, 2016

Michelle K. Lee

Michelle K. Lee
*Director of the United States Patent and Trademark Office*